US007987554B2

(12) United States Patent
Hakamata et al.

(10) Patent No.: US 7,987,554 B2
(45) Date of Patent: Aug. 2, 2011

(54) HINGE STRUCTURE FOR VEHICLE OPEN/CLOSE BODY

(75) Inventors: Koki Hakamata, Wako (JP); Eita Yamaki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 337 days.

(21) Appl. No.: 12/362,026

(22) Filed: Jan. 29, 2009

(65) Prior Publication Data

US 2009/0193618 A1 Aug. 6, 2009

(30) Foreign Application Priority Data

Jan. 31, 2008 (JP) ..... 2008-020711
Jan. 31, 2008 (JP) ..... 2008-021224

(51) Int. Cl.
*E05D 11/00* (2006.01)

(52) U.S. Cl. ..... 16/250; 296/76

(58) Field of Classification Search ..... 16/250; 296/76, 193.08, 146.8, 193.11, 146.11; 180/69.2, 180/69.21; 49/398
See application file for complete search history.

(56) References Cited

U.S. PATENT DOCUMENTS

| | | | | |
|---|---|---|---|---|
| 3,623,764 | A * | 11/1971 | Jacobus | 296/50 |
| 5,224,240 | A * | 7/1993 | Smith et al. | 16/251 |
| 6,317,925 | B1 * | 11/2001 | Pietryga et al. | 16/250 |
| 7,618,084 | B2 * | 11/2009 | Kimura | 296/146.8 |

FOREIGN PATENT DOCUMENTS

| | | |
|---|---|---|
| DE | 76 04 352 | 6/1976 |
| JP | 56-025063 | 3/1981 |
| JP | 11-136830 | 5/1999 |
| JP | 2003-333723 | 11/2003 |

* cited by examiner

*Primary Examiner* — William L. Miller
(74) *Attorney, Agent, or Firm* — Rankin, Hill & Clark LLP

(57) ABSTRACT

A hinge structure for a vehicle open/close body, in which a long hinge member supporting the open/close body is rotatably disposed in an opening portion of a vehicle body and the hinge member rotates according to an opening and closing motion of the open/close body, wherein a cover member for covering the hinge member is disposed in the hinge member; and wherein a shape of an outer periphery surface of the cover member facing a corner portion of the opening portion is formed in a shape following a shape of the corner portion.

18 Claims, 14 Drawing Sheets

1 Hinge structure
Cover member
30
10 Hinge member
11 Arm member
Linear member
20
Hinge body
12

HINGE STRUCTURE FOR VEHICLE OPEN/CLOSE BODY

CROSS REFERENCE TO RELATED APPLICATIONS

This application claims the foreign priority benefit under Title 35, United States Code, §119(a)-(d) of Japanese Patent Application No. 2008-020711, filed on Jan. 31, 2008 and Japanese Patent Application No. 2008-021224, filed on Jan. 31, 2008, the contents of which are hereby incorporated by reference.

BACKGROUND OF THE INVENTION

1. Field of the Invention

The present invention relates to a hinge structure for a vehicle open/close body, such as a door and a trunk lid of a vehicle, for rotatably fixing the vehicle open/close body to a vehicle body.

2. Description of Related Art

Conventionally, when a linear member such as a harness and a wire for various devices such as a lamp installed in a door or a trunk lid of a vehicle is wired, the linear member is wired along a long hinge member constituting a hinge mechanism of the door and trunk lid.

FIG. 15 is an illustration showing an installation condition of a hinge structure of a conventional vehicle open/close body, which is an enlarged perspective view of a corner portion of a trunk lid when the open/close body is opened. FIG. 16 is also an illustration showing an installation condition of a hinge structure of a conventional vehicle open/close body, which is an enlarged perspective view of a corner portion of a trunk lid when the open/close body is opened. FIG. 17 is an illustration showing a hinge structure of a conventional vehicle open/close body, which is an enlarged cross sectional view of a main portion of a hinge member provided with a harness.

For example, as shown in FIG. 17, a hinge structure 400 is disclosed in Japanese Patent Laid-open Publication No. 2003-333723, in which a long protector body 410 having a U-shaped cross section for housing a harness 430 is disposed along a long hinge member 450, and an outer periphery of the protector body 410 and hinge member 450 is covered by a cover member 470 having a U-shaped cross section and a cap member 420. Meanwhile, the long hinge member 450 has a concave groove 451 along an extending direction thereof and another harness 440 is housed in the concave groove 451.

Conventionally, as shown in FIG. 15 and FIG. 16, a trunk room 110 for putting baggage is disposed in a rear portion of a vehicle body. An opening portion 120 of the trunk room 110 is opened and closed by an open/close body such as a trunk lid for putting the baggage in the trunk room 110. The open/close body is rotatably fixed to a vehicle body 100 via, for example, long hinge members 210, 310. Each front end portion of a pair of the hinge members 210, 310 is fixed to right and left sides of the open/close body, and each anchor portion thereof is rotatably fixed to an axis of the vehicle body 100 by passing through each of the right and left corner portions 121 of the trunk room 110.

A weather-strip 500 made of rubber is disposed on a periphery of the opening portion 120 of the trunk room 110. The opening portion 120 to which the weather-strip 500 is fixed is formed such that a corner portion 121 is formed in a circular arc. In addition, the open/close body such as a door and a trunk lid of the vehicle may be provided with various devices such as a lamp and a locking device. These various devices may be provided with a linear member such as a harness for connecting the devices to, for example, a power source installed in the vehicle body and a wire for opening the trunk lid.

Conventionally, as shown in FIG. 15 to FIG. 17, when the linear members such as the harness and wire are connected to the various devices of the open/close body, the linear members are wired along the long hinge members 210, 310, 450 which constitute a hinge mechanism of the door or the trunk room.

For example, in a hinge structure 200 shown in FIG. 15, a clip 240 for holding harnesses 220, 230 is disposed on a lateral surface of the hinge member 210 having a square cross section, and the harnesses 220, 230 are fixed on the lateral surface of the hinge member 210 by the clip 240.

In addition, in a hinge structure 300 shown in FIG. 16, the hinge member 310 is formed in a U-shape in cross section so that the harness 320 can be housed in the hinge member 310, thereby the harness 320 is housed inside the hinge member 310 and held by a tape 330 and the like.

However, in the hinge structure 200 shown in FIG. 15, since the harnesses 220, 230 are disposed on the lateral surface of the hinge member 210, the hinge member 210 protrudes by an installation space S200 of the harnesses 220, 230 toward the edge of the trunk room 110.

On the other hand, when the hinge member 210 is disposed close to an edge of the opening portion 120 in the vehicle width direction for reducing the protrusion of the hinge member 210 toward the trunk room 110, since the corner portion 121 is formed in the circular arc, a distance L200 between the hinge member 210 and a front edge of the opening portion 120 becomes long, thereby resulting in producing a wide gap between the hinge member 210 and the front periphery of the opening portion 120.

In addition, in the hinge structure 200, since the harnesses 220, 230 are barely disposed on the lateral surface of the hinge member 210, the appearance is not good.

In addition, in the hinge structure 300 shown in FIG. 16, since the hinge member 310 having a U-shaped cross section has a role of covering the harness 320, the harness 320 is hardly seen from the rear side of the vehicle, thereby resulting in improvement of the appearance. However, since the harness 320 is housed in the hinge member 310, the hinge member 310 grows in size.

In addition, since the hinge member 310 is not formed in a shape following the shape of the corner portion 121, if the hinge member 310 is disposed close to the front edge of the opening portion 120, a gap S300 between a side edge of the opening portion 120 and the hinge member 310 becomes wide although a gap L300 between the front edge of the opening portion 120 and the hinge member 310 becomes narrow.

Therefore, a protrusion S400 of a lining 130, where an anchor portion of the hinge member 310 is housed, becomes large due to growing of the hinge member 310 in size and expansions of the gaps L330, S300, thereby resulting in producing a small storage space of the trunk room 110 for putting the baggage therein.

In a structure of the opening portion 120 of, for example, a door or a trunk room, it is preferable to dispose the door hinge structures 200, 300 as close to the corner portion 121 of the opening portion 120 as possible for widely utilizing the opening portion 120.

However, in a door hinge structure 400 (Japanese Patent Laid-open Publication No. 2003-333723) shown in FIG. 17, since a cross section of a hinge member 470 grows in size to protrude inside the opening portion, the space of the opening portion is reduced.

In addition, a corner portion of the opening portion is formed in a curved shape (circular arc) in many cases. However, since the conventional door hinge structure 400 is formed in an angulated shape, if the door hinge structure 400 is moved close to the corner portion of the opening portion, a clearance between the door hinge structure 400 and the corner portion varies, thereby resulting in deterioration of the appearance.

The present invention has been developed considering the problems described above, and it is, therefore, an object of the present invention to provide a hinge structure for a vehicle open/close body, which reduces the protrusion toward the opening portion, as well as improves appearance of the vehicle when the vehicle open/close body is opened.

SUMMARY OF THE INVENTION

According to a first aspect of the present invention, there is provided a hinge structure for a vehicle open/close body, in which a long hinge member supporting the open/close body is rotatably disposed in an opening portion of a vehicle body and the hinge member rotates according to an opening and closing motion of the open/close body, wherein a cover member for covering the hinge member is disposed in the hinge member; and wherein a shape of an outer periphery surface of the cover member facing a corner portion of the opening portion is formed in a shape following a shape of the corner portion.

In the configuration described above, since the outer periphery surface of the cover member facing the corner portion of the opening portion is formed in the shape following the shape of the corner portion, a clearance between the corner portion of the opening portion and the outer periphery surface of the cover member becomes approximately constant, thereby resulting in improvement of a appearance around the opening portion when the open/close body is opened. In addition, since the hinge structure can be moved close to the corner portion as a whole (uniformly), a protrusion of the hinge structure inward the opening portion can be made small. As a result, a large space in the opening portion can be secured and interferences to baggage by the hinge structure can be suppressed to the minimum.

In addition, it is preferable that the cover member includes an outer cover to be disposed on a side of the corner portion and an inner cover to be clipped to the outer cover from an inner side of the opening portion.

In the configuration described above, since the cover member consists of two members of the outer cover and the inner cover, a level of freedom for designing each of the two members can be increased. Therefore, the shape of the outer periphery surface of the outer cover can be easily formed so as to follow the shape of the corner portion. In addition, the shape of the inner cover can be formed to less protrude inward the opening portion as small as possible.

It is preferable that the outer cover and the inner cover are fixed to the hinge member.

In the configuration described above, since the outer cover and the inner cover are independently held on the hinge member, a workability of fixing the cover member can be improved.

In addition, it is preferable that the hinge member is disposed near the corner portion in a cross section of the cover member.

In the configuration described above, since the hinge member is disposed near the corner portion in the cross section of the cover member, a level of freedom for designing a portion of the cover member distant from the corner portion can be increased, thereby resulting in less protrusion of the cover member inward the opening portion.

It is preferable that the hinge member is disposed adjacent to the outer cover in the cross section of the cover member.

In the configuration described above, since the hinge member is disposed adjacent to the outer cover in the cross section of the cover member, a level of freedom for designing the inner cover can be increased, thereby resulting in less protrusion of the inner cover inward the opening portion.

In addition, it is preferable that the hinge structure includes a linear member to be disposed along the hinge member, and the linear member is disposed on a surface containing a rotation trajectory of the hinge member and adjacent to the hinge member.

In the configuration described above, since the liner member is disposed on the surface containing the rotation trajectory of the hinge member, a width dimension of the cover member in a direction perpendicular to the surface can be made small. As a result, a protrusion of the cover member inward the opening portion can be suppressed as small as possible.

In addition, according to a second aspect of the present invention, there is provided a hinge structure for a vehicle open/close body, in which a long hinge member supporting the open/close body is rotatably disposed in an opening portion of a vehicle body and the hinge member rotates according to an opening and closing motion of the open/close body, wherein a shape of a cross section of the hinge member in an extending direction of the hinge member is formed in a shape following a shape of a corner portion of the opening portion; and wherein the hinge member is disposed near the corner portion and a cover member is clipped to the hinge member from an inner side of the opening portion.

In the configuration described above, since the shape of the cross section of the hinge member in the extending direction of the hinge member is formed in the shape following the shape of the corner portion of the opening portion, a clearance between the corner portion of the opening portion and a facing surface of the hinge member facing the corner portion becomes approximately constant. Therefore, the hinge structure can be moved close to the corner portion as a whole (uniformly), and a protrusion of the hinge structure inward the opening portion can be made small. As a result, a large space in the opening portion can be secured and interferences to baggage by the hinge structure can be suppressed to the minimum. In addition, since the hinge structure is disposed near the corner portion and the cover member is clipped to the hinge member from the inner side of the opening portion, an inner side of the hinge member is shadowed by the hinge member when the open/close body is opened, thereby resulting in improvement of the appearance around the opening portion when the open/close body is opened.

In addition, it is preferable that the hinge member includes a hinge body to which the cover member is fixed and an arm member whose one end is fixed to the hinge body and the other end is rotatably fixed to the vehicle body.

In the configuration described above, since the hinge body and the arm member are formed independently in the hinge member, a level of freedom for designing the hinge body can be increased and the hinge member having the shape following the shape of the corner portion can be easily formed. Since the hinge body and the arm member are formed independently, the hinge member can be easily applied to an automatic opening and closing device for opening and closing the open/close body by, for example, using a configuration where a driving force is applied to the arm member.

In addition, it is preferable that a linear member is disposed along the hinge member and the linear member is held by the cover member made of resin.

In the configuration described above, since the cover member, which does not require strength, is made of resin having an excellent formability, a level of freedom for designing the cover member can be increased. Therefore, the cover member and a clipping means for clipping the cover member to the hinge member are easily integrated. Since the cover member can be formed compact even if the cover member holds a linear member, a protrusion of the cover member inward the opening portion can be suppressed.

In addition, it is preferable that the linear member is disposed along the hinge member, and the linear member is held by the hinge member made of metal.

In the configuration described above, since the hinge member, which requires strength for strongly holding the open/close body, is made of metal, the hinge member can strongly holds the open/close body. In addition, since the linear member can be held in advance on the hinge member which is fixed to the vehicle body in advance, the cover member can be easily assembled.

According to the present invention, a hinge structure for a vehicle open/close body can be provided, which reduces the protrusion inward the opening portion as well as improves the appearance around the opening portion when the vehicle open/close body is opened.

DETAILED DESCRIPTION OF THE PREFERRED EMBODIMENT

Preferred embodiments of the present invention will be explained by referring to drawings. In the explanation, an identical component will be labeled with the same number and duplicated explanation will be omitted. In the embodiments, a hinge structure for a vehicle open/close body which is applied to a trunk lid of a vehicle (hereinafter, referred to as hinge structure) is exemplified to explain the embodiments. It is noted when a direction is discussed in the embodiments, right, left, front, and rear of the vehicle will be used as a basis for the right, left, front, and rear in the embodiments.

First Embodiment

Figure 1:
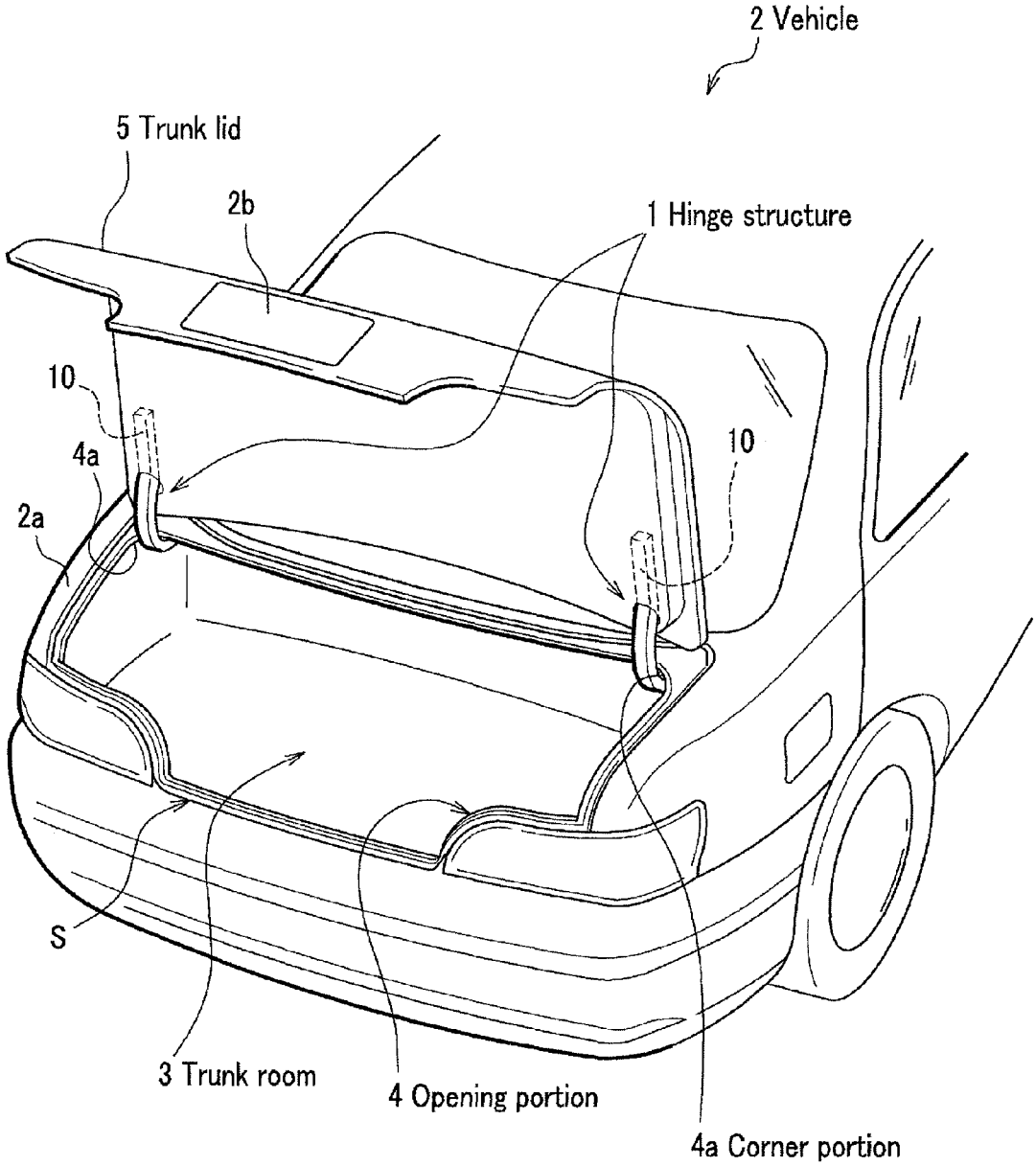
FIG. 1 is a perspective view of a vehicle provide with a hinge structure according to a first embodiment of the present invention as seen from obliquely rear upper.

FIG. 1 is a perspective view of a vehicle provided with a hinge structure according to a first embodiment of the present invention as seen from obliquely rear upper.

As shown in FIG. 1, a vehicle 2 includes a trunk room 3 and a trunk lid 5 for opening and closing an opening portion 4 of the trunk room 3. A hinge structure 1 according to the embodiment is a device for rotatably fixing the trunk lid 5, which is an open/close body, to a vehicle body. One end of the hinge structure 1 is fixed to a backside of the trunk lid 5, and the other end of the hinge structure 1 is rotatably fixed to the vehicle body inside the trunk room 3. In addition, the hinge structure 1 is disposed in each of right end portion and left end portion of the trunk lid 5 and each of right corner portion 4*a* and left corner portion 4*a* of the opening portion 4. It is noted that the right and left corner portions 4*a* (more specifically, right and left corner portions on front side of opening portion 4) are formed in a curved-shape. Since the hinge structures 1 on the right and left are symmetrical, the hinge structure 1 disposed on the left will be mainly explained in the later explanation.

Figure 2A:
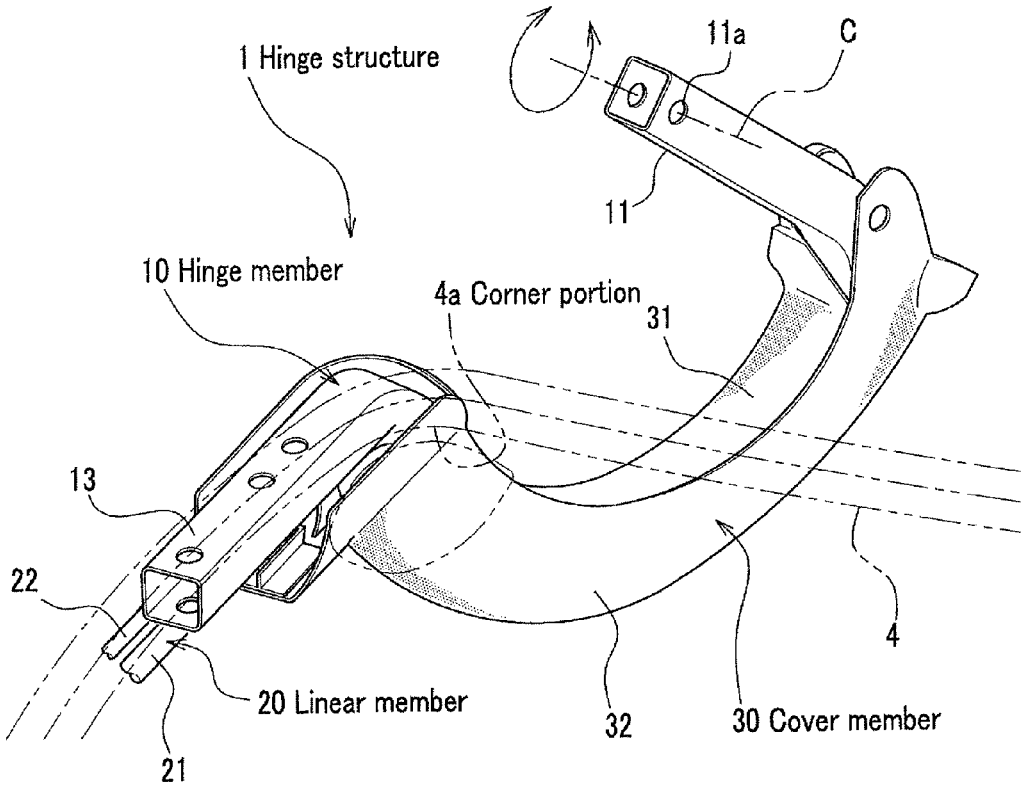
FIG. 2A is a perspective view of a hinge structure showing a closing state of a trunk lid according to the first embodiment.
Figure 2B:
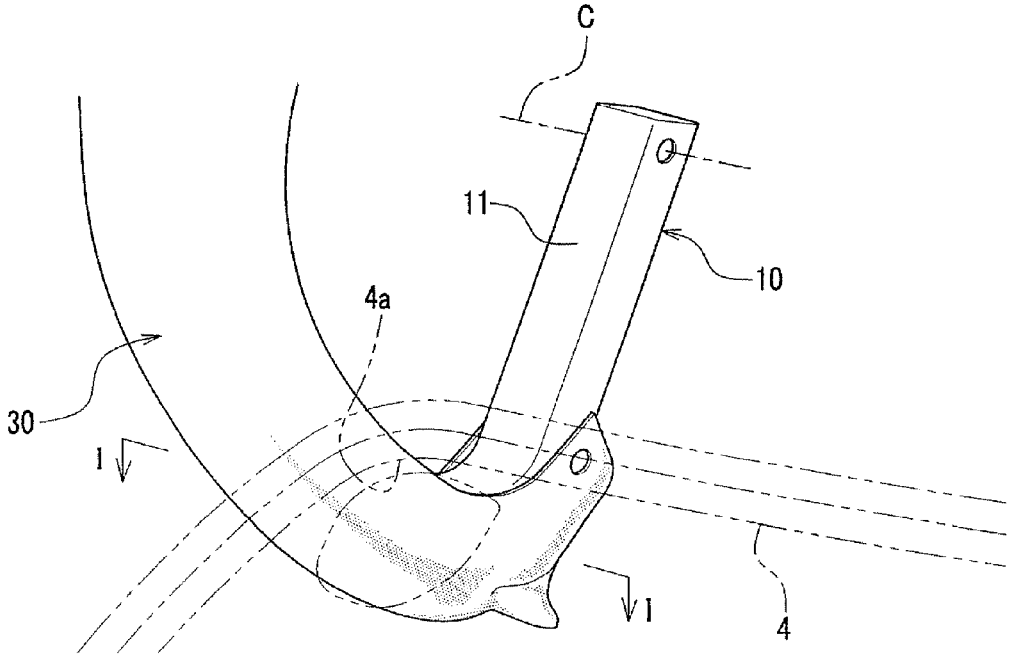
FIG. 2B is a perspective view of the hinge structure showing an opening state of the trunk lid according to the first embodiment.
Figure 3:
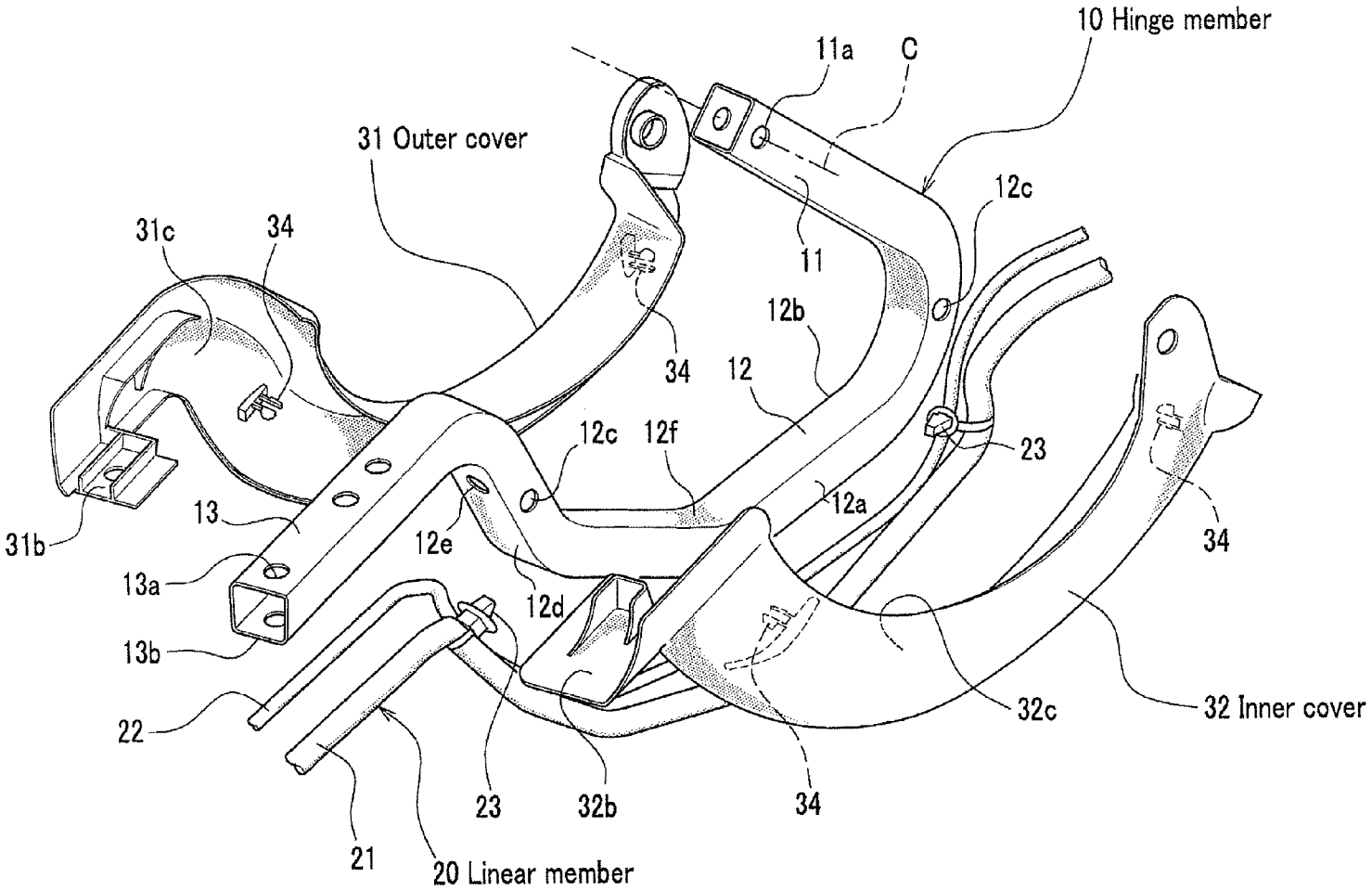
FIG. 3 is an exploded perspective view of a hinge structure according to the first embodiment.

FIG. 2A is a perspective view of a hinge structure showing a closing state of a trunk lid according to the first embodiment. FIG. 2B is a perspective view of the hinge structure showing an opening state of the trunk lid according to the first embodiment. FIG. 3 is an exploded perspective view of a hinge structure according to the first embodiment.

As shown in FIG. 2A, FIG. 2B, and FIG. 3, the hinge structure 1 mainly consists of a long hinge member 10 formed into a hook, a linear member 20 wired along the hinge member 10, and a cover member 30 covering the hinge member 10 and the linear member 20.

As shown in FIG. 3, the hinge member 10 is a metal member which supports the trunk lid 5, and formed by, for example, a long rectangular tubular member. The hinge member 10 includes an axis support portion 11 whose one end is rotatably fixed to the vehicle body (not shown), a curved portion 12 extending with curvature toward a rear direction from the other end of the axis support portion 11, and a trunk lid fixing portion 13 extending along a backside of the trunk lid 5 from the end portion of the curved portion 12 opposite to the axis support portion 11.

On one end of the axis support portion 11, a through hole 11*a* for inserting a rotation axis C therein is formed.

The curved portion 12 is curved curving along a circle having a predetermined radius centering on the rotation axis C. An edge portion of the opening portion 4 of the trunk room 3 is arranged in a space between the axis support portion 11 and the curved portion 12 (see FIG. 2A, FIG. 2B). On lateral surfaces 12*a*, 12*b* on the right and left of the curved portion 12, a cover fixing hole 12*c* for fixing the cover member 30 is bored. In addition, on a lateral surface 12*d* of the curved portion 12 opposite to the rotation axis C, a linear member fixing hole 12*e* for fixing the linear member 20 is bored.

A trunk lid fixing portion 13 is fixed to the backside of the trunk lid 5 with, for example, a bolt. In the trunk lid fixing portion 13, a bolt insertion hole 13*a* for inserting the bolt is bored in a vertical direction.

As shown in FIG. 3, the linear member 20 consists of, for example, a harness 21 to be connected to a lamp (not shown) for lighting a number plate disposed on the trunk lid 5 and the like and an open cable 22 to be connected to a locking device (not shown) of the trunk lid 5.

The harness 21 is disposed on a surface containing a rotation trajectory of the hinge member 10 and adjacent to the hinge member 10. In more detail, the harness 21 is disposed adjacent to the lateral surface 12*d* of the curved portion 12 opposite to the rotation axis C and on the lateral surface 13*b* of the trunk lid fixing portion 13 opposite to the trunk lid 5. The harness 21 is fixed to the hinge member 10 by a harness clip 23 described later.

Figure 4:
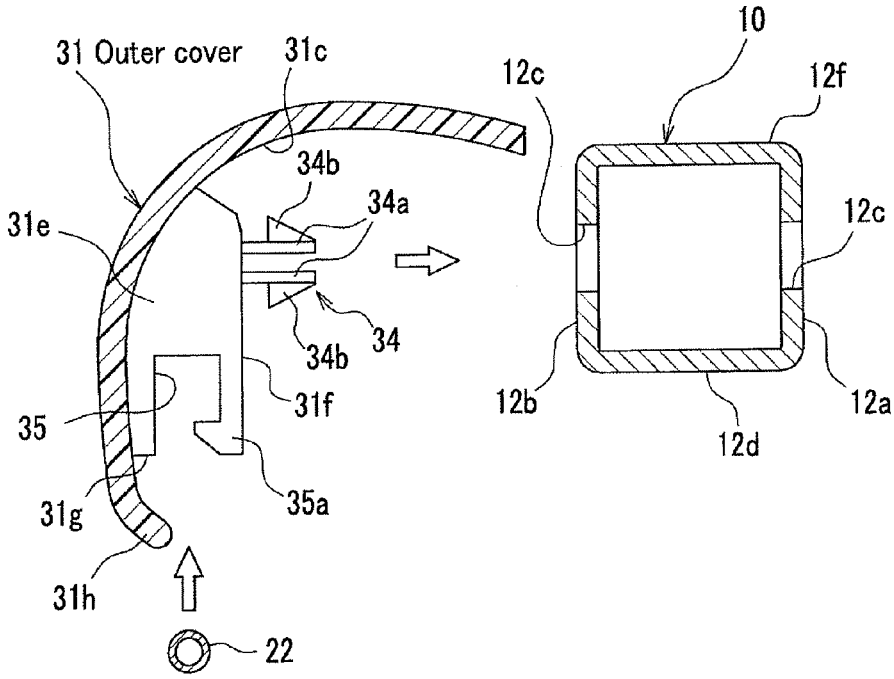
FIG. 4 is a cross sectional view of an outer cover.

An open cable 22 is disposed a little exterior of the vehicle from the surface containing the rotation trajectory of the hinge member 10 (see FIG. 4). The open cable 22 is held by a cover member 30 described later. Meanwhile, the open cable 22 is, for example, a cable for transmitting an operation of unlocking lever (not shown) disposed in the driver's seat to the locking device of the trunk lid 5, and if the unlocking lever is pulled, the locking device of the trunk lid 5 is unlocked.

As shown in FIG. 2A, FIG. 2B, and FIG. 3, the cover member 30 is a resin hollow member which covers a whole lateral surface of the curved portion 12 of the hinge member 10 and a lateral surface of the trunk lid fixing portion 13 except a surface on the side of the trunk lid 5. The cover member 30 consists of an outer cover 31 disposed on a side of the corner portion 4*a* of the opening portion 4 and an inner cover 32 disposed on an inner side of the opening portion 4.

As shown in FIG. 3, the outer cover 31 is a thin plate member extending along the curved portion 12 of the hinge member 10 and the trunk lid fixing portion 13. The outer cover 31 is formed in approximately a reverse-J shape in cross sectional view (see FIG. 4). On an inner periphery surface 31*c* of the outer cover 31, a clip 34 to be clipped to a cover fixing hole 12*c* of the curved portion 12 is disposed. In addition, at an end portion of the outer cover 31 on the side of the trunk lid 5, a bottom wall 31*b* which covers a lateral surface 13*b* of the trunk lid fixing portion 13 on the opposite side of the trunk lid 5 is formed.

The inner cover 32 is, as with the outer cover 31, a thin plate member extending along the curved portion 12 of the hinge member 10 and the trunk lid fixing portion 13. The inner cover 32 is formed in approximately a J-shape in a cross sectional view (see FIG. 5). On an inner periphery surface 32*c* of the inner cover 32, a clip 34 to be clipped to a cover fixing hole 12*c* of the curved portion 12 is disposed. In addition, at an end portion of the inner cover 32 on the side of the trunk lid 5, a bottom wall 32*b* which covers the lateral surface 13*b* of the trunk lid fixing portion 13 on the opposite side of the trunk lid 5 is formed.

FIG. 4 is a cross sectional view of an outer cover.

As shown in FIG. 4, on the inner periphery surface 31*c* of the outer cover 31, a wall-like lateral rib 31*e* is formed in a direction perpendicular to an extending direction of the outer cover 31. In addition, a clip 34 is vertically formed at an end portion 31*f* of the lateral rib 31*e* on the side of the hinge member 10.

The clip 34 includes a pair of rod-like anchor portions 34*a* which are vertically formed at a distance from each other and a tapered clipping portion 34*b* which is projectedly formed on each side of the anchor portions 34*a*. The clipping portion 34*b* is formed to become wider toward the lateral rib 31*e*. The rod-like anchor portion 34*a* is elastically deformed when it is inserted into the cover fixing hole 12*c*, and if the clipping portion 34*b* passed through the cover fixing hole 12*c*, the rod-like anchor portion 34*a* restores to original form. Therefore, the clipping portion 34*b* is clipped to the periphery edge of the cover fixing hole 12*c*, thereby resulting in fixing the outer cover 31 to the hinge member 10.

In addition, on a side end portion 31*g* of the lateral rib 31*e*, a holding groove 35 for holding the open cable 22 is disposed. On a side of the holding groove 35 on the side of the hinge member 10, a tapered protruding portion 35*a* is projectedly formed. When the open cable 22 is fit in the holding groove 35, the protruding portion 35*a* clips the open cable 22 so that the open cable 22 is not unclipped from the holding groove 35.

Figure 5:
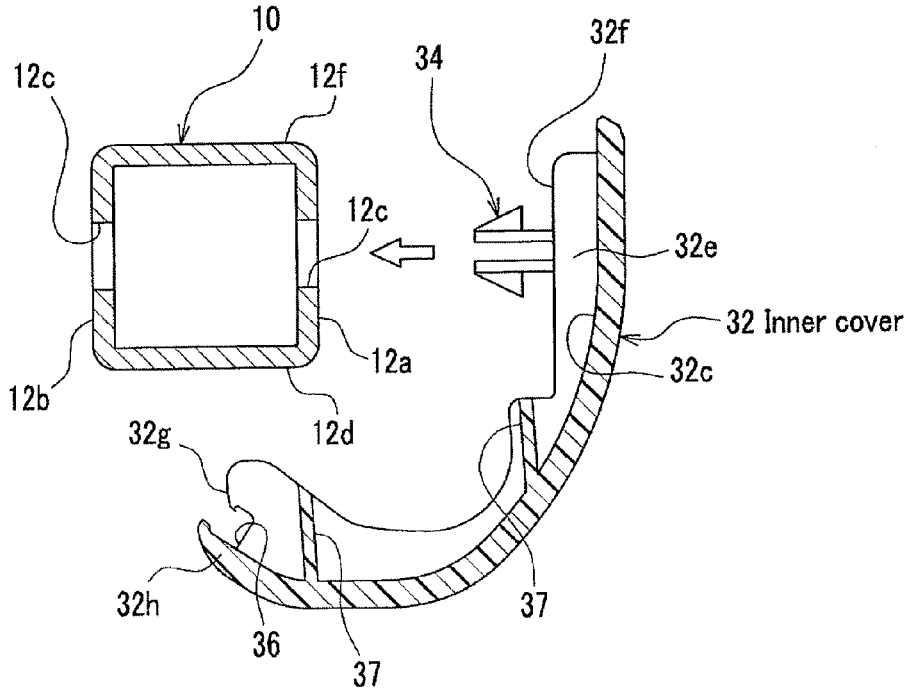
FIG. 5 is a cross sectional view of an inner cover.

FIG. 5 is a cross sectional view of an inner cover.

As shown in FIG. 5, on the inner periphery surface 32*c* of the inner cover 32, a wall-like lateral rib 32*e* is formed in a direction perpendicular to an extending direction of the inner cover 32. In addition, the clip 34 is vertically formed at an end portion 32*f* of the lateral rib 32*e* on the side of the hinge member 10. Since the clip 34 of the inner cover 32 has a structure approximately identical to that of the outer cover 31, the detailed explanation will be omitted.

In addition, in a side end portion 32*g* of the lateral rib 32*e*, a concave portion 36 for clipping a side edge 31*h* (see FIG. 4) which is one of side peripheries of the outer cover 31 is formed. If the side edge 31*h* of the outer cover 31 is fit in the concave portion 36, the side edge 31*h* of the outer cover 31 is sandwiched by a side edge 32*h*, which is one of side peripheries of the inner cover 32, and the side end portion 32*g* of the lateral rib 32*e*. Although not shown, it is noted that a plurality of the lateral ribs 32*e* are formed at a distance from each other in the extending direction of the inner cover 32. Each of the lateral ribs 32*e* are connected by two longitudinal ribs 37 formed along the extending direction of the inner cover 32.

Figure 6:
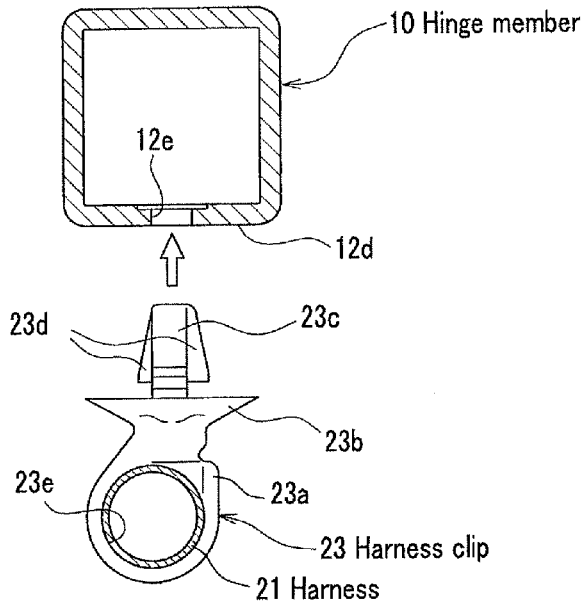
FIG. 6 is a side view of a harness clip.

FIG. 6 is a side view of a harness clip.

As shown in FIG. 6, a harness clip 23 is a resin member for fixing the harness 21 to a linear member fixing hole 12*e* of the hinge member 10. The harness clip 23 is provided with an annular portion 23*a*, a contact portion 23*b*, a projecting portion 23*c*, and a clipping portion 23*d*.

The annular portion 23*a* includes an inserting hole 23*e* for inserting the harness 21. The contact portion 23*b* having a circular truncated cone shape is formed on the hinge member 10 side of the annular portion 23*a*. The contact portion 23*b* comes in contact with the lateral surface 12*d* of the hinge member 10 when the harness clip 23 is fixed to the hinge member 10. The rod-like projecting portion 23*c* is projectedly formed on the hinge member 10 side of the contact portion 23*b*. A plurality of the tapered clipping portions 23*d* are projectedly formed on the side of the projecting portion 23*c*. The clipping portions 23*d* are formed to become wider toward the contact portion 23*b*. The clipping portion 23*d* is elastically deformed when it is inserted into a linear member fixing hole 12*e*, and if the clipping portion 23*d* passed through the linear member fixing hole 12*e*, the clipping portion 23*d* restores to original form. As a result, the clipping portion 23*d* is clipped to the periphery edge of the linear member fixing hole 12*e*.

Figure 7:
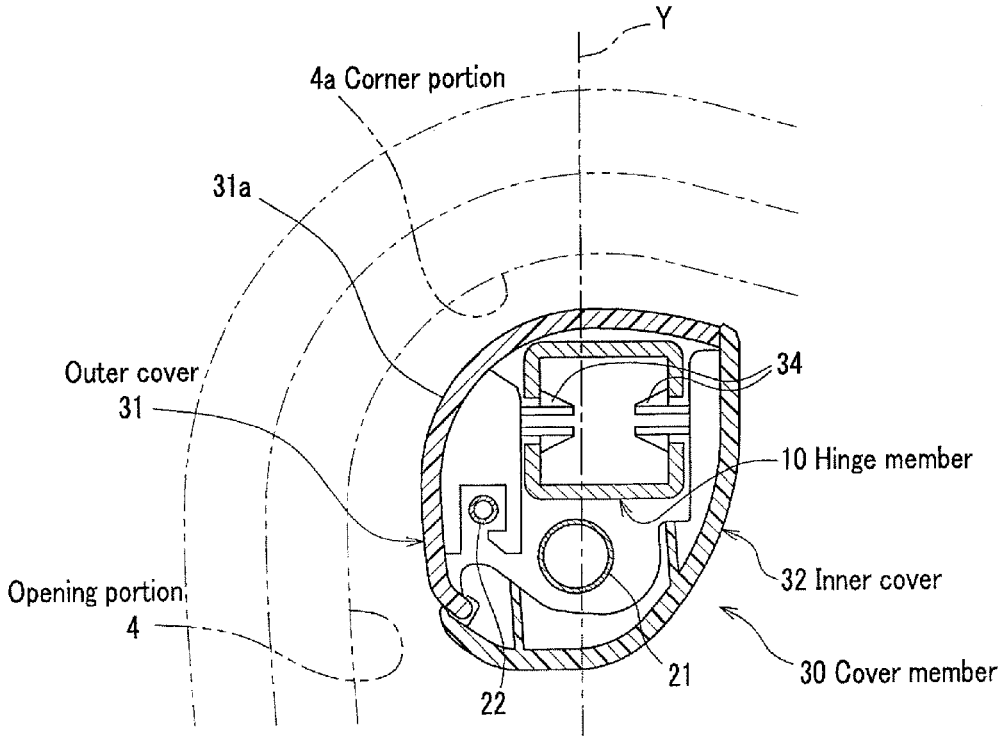
FIG. 7 is a cross sectional view taken along I-I line of FIG. 2B.

Next, operations and effects of the hinge structure 1 according to the embodiment will be explained by mainly referring to FIG. 7. FIG. 7 is a cross sectional view taken along I-I line of FIG. 2B.

As shown in FIG. 7, a portion facing the corner portion 4*a* of the opening portion 4 in the outer periphery surface of the cover member 30, that is, an outer periphery surface 31*a* of the outer cover 31 is formed in a shape following the shape of the corner portion 4*a* of the opening portion 4. In other words, the outer periphery surface 31*a* of the outer cover 31 is formed approximately in parallel with the corner portion 4*a* of the opening portion 4. Therefore, a distance between the outer periphery surface 31*a* of the outer cover 31 and the corner portion 4*a* becomes almost constant, thereby resulting in improvement of the appearance of the hinge structure 1.

In addition, each of the outer cover 31 and the inner cover 32 is fixed to the hinge member 10 through the clip 34. That is, in the conventional hinge structure 400 shown in FIG. 17, when the cover member 470 is fixed to the hinge member 450, it is required that the cover member 470 and cap member 420 are clipped to each other. However, in the hinge structure 1 according to the embodiment, since each of the outer cover 31 and the inner cover 32 is separately held on the hinge member 10, workability of assembling the cover member 30 can be improved.

In addition, as shown in FIG. 7, in the hollow portion of the cover member 30 which is formed by combining the outer cover 31 and inner cover 32, the hinge member 10 is arranged at a position close to the corner portion 4*a*, that is, the position near the corner portion 4*a*, compared with the harness 21 and open cable 22. In addition, the hinge member 10 is arranged adjacent to the outer cover 31 in the hollow portion of the cover member 30.

Therefore, a level of freedom for designing the inner cover 32 which constitutes a part of the cover member 30 distant from the corner portion 4*a* is improved. As a result, the inner cover 32 can be formed so as to protrude less inward toward the opening portion.

In addition, as shown in FIG. 7, the harness 21 is disposed on a surface Y containing the rotation trajectory of the hinge member 10 and adjacent to the hinge member 10. Therefore, a width dimension of the cover member 30 in a direction perpendicular to the surface Y can be made small. As a result, a protrusion of the cover member 30 inward to the opening portion 4 can be reduced or made small.

Second Embodiment

A second embodiment of the present invention will be explained in detail by referring to FIG. 1, FIG. 8A to 8D, and FIG. 9A to 9B.

As shown in FIG. 1, the vehicle 2 includes the trunk room 3 for putting baggage in a vehicle body rear portion, the trunk lid (open/close body) 5 for opening and closing the opening portion 4 of the trunk room 3, and the hinge structure 1 for rotatably fixing the trunk lid 5 to a vehicle body 2*a*.

The hinge structure 1 according to the second embodiment is a device for rotatably fixing the trunk lid 5, which is the open/close body, to the vehicle body 2*a*, and a long hinge member 10 for rotatably fixing the trunk lid 5 is arranged near the corner portion 4*a* of the opening portion 4 of the vehicle body 2*a*. Therefore, the hinge member 10 rotatably moves according to opening and closing motions of the trunk lid 5 (see FIG. 8A). One end of the hinge structure 1 is fixed to a backside of the trunk lid 5 and the other end of the hinge structure 1 is rotatably fixed to the vehicle body 2*a* inside the trunk room 3. In addition, the hinge structure 1 is disposed in the vicinity of each of right and left end portions of the trunk lid 5 and each of right and left corner portions 4*a* of the opening portion 4.

The trunk room 3 is a luggage compartment capable of loading or unloading baggage by opening the trunk lid 5 in rear upper direction from the rear side of the opening portion 4.

On the periphery edge of the opening portion 4, a sealing material S such as a resin weather-strip is fixed, and when the opening portion 4 is closed by the trunk lid 5, the trunk lid 5 presses the sealing material S to be tightly contacted, thereby resulting in seal-up of the trunk room 3.

The trunk lid 5 consists of, for example, a capping body made of rolled plate, and provided with, for example, a number plate 2*b*, a lighting device (not shown) for lighting the number plate 2*b*, and a locking device (not shown). It is noted that the right and left corner portions 4*a* (more specifically, right and left corner portions on the front side of opening portion 4) are formed in a curved-shape (circular arc). Since the hinge structures 1 on the right and left have a symmetrical structure to each other, the hinge structure 1 disposed on the left will be mainly explained by referring to FIG. 8A to 8D and FIG. 9A to 9B in the later explanation.

Figures 8A, 8B, 8C, 8D:
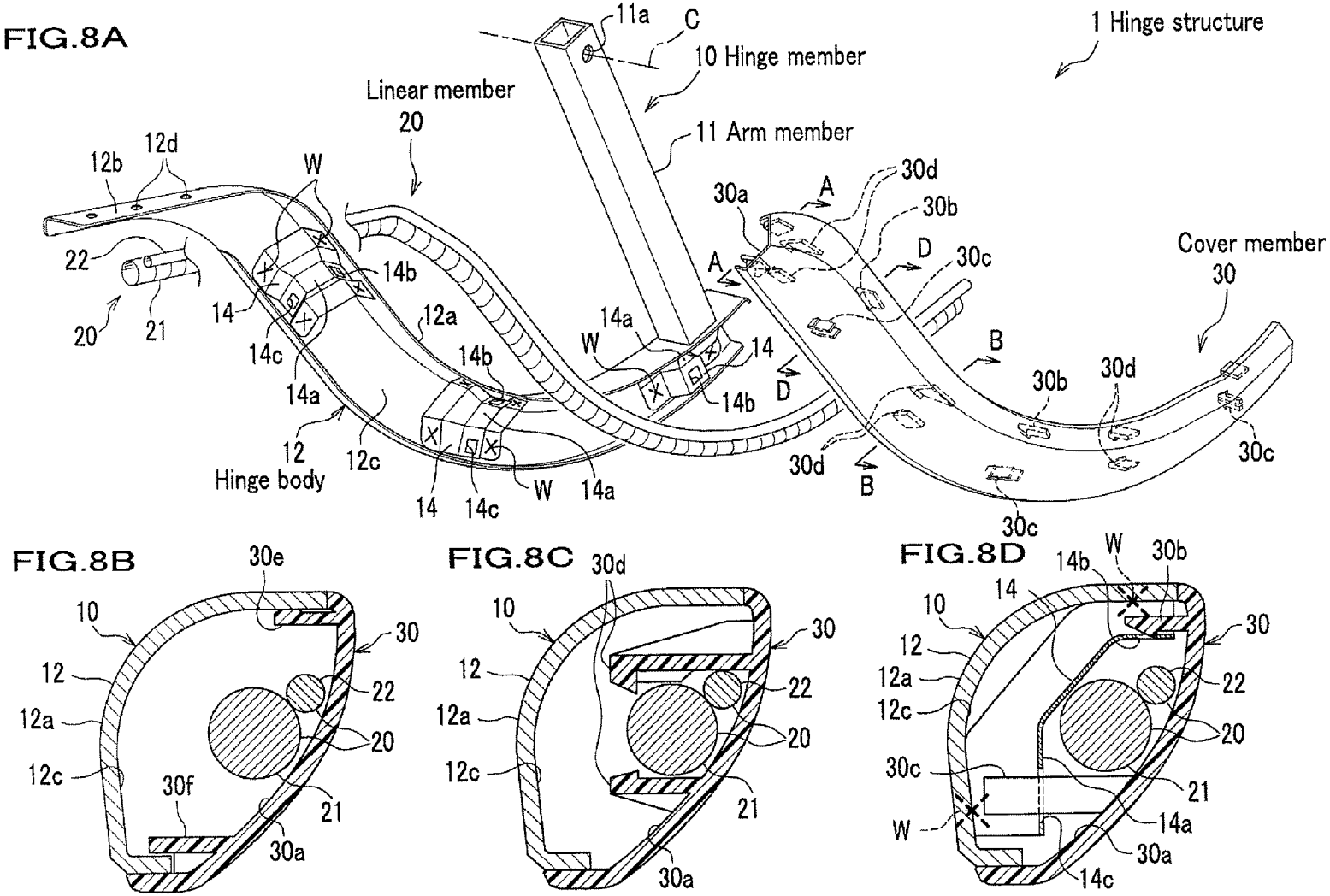
FIG. 8A is an exploded perspective view showing a hinge structure according to a second embodiment of the present invention.
FIG. 8B is an enlarged cross sectional view showing the hinge structure according to the second embodiment taken along A-A line of FIG. 8A after assembly.
FIG. 8C is an enlarged cross sectional view showing the hinge structure according to the second embodiment taken along B-B line of FIG. 8A after assembly.
FIG. 8D is an enlarged cross sectional view showing the hinge structure according to the second embodiment taken along D-D line of FIG. 8A after assembly.
Figure 9A:
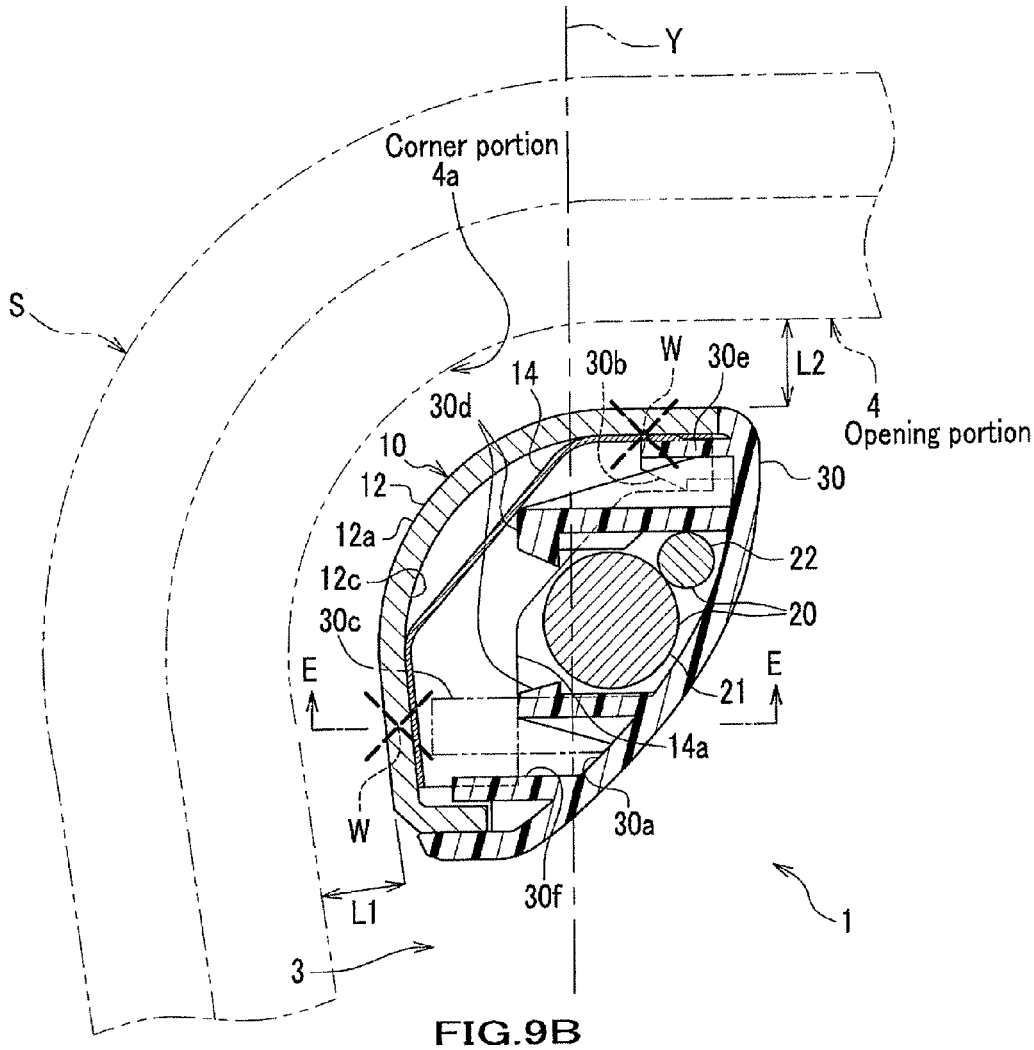
FIG. 9A is an illustration showing a hinge structure according to the second embodiment, which is an enlarged cross sectional view showing an installation condition of the hinge structure in an opening portion of a trunk lid.
Figure 9B:
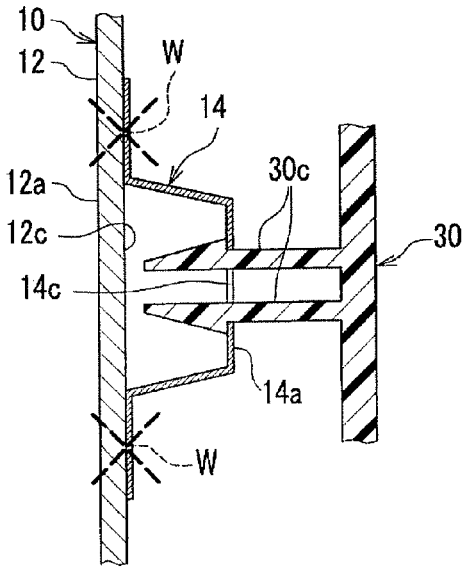
FIG. 9B is an illustration showing a hinge structure according to the second embodiment, which is an enlarged cross sectional view taken along E-E line of FIG. 9A.

FIG. 8A is an exploded perspective view showing a hinge structure according to the second embodiment. FIG. 8B is an enlarged cross sectional view of the hinge structure according to the second embodiment taken along A-A line of FIG. 8A after assembly. FIG. 8C is an enlarged cross sectional view showing the hinge structure according to the second embodiment taken along B-B line of FIG. 8A after assembly. FIG. 8D is an enlarged cross sectional view showing the hinge structure according to the second embodiment taken along D-D line in FIG. 8A after assembly. FIG. 9A is an illustration showing a hinge structure according to the second embodiment, which is an enlarged cross sectional view showing an installation condition of the hinge structure in an opening portion of a trunk lid. FIG. 9B is an illustration showing a hinge structure according to the second embodiment, which is an enlarged cross sectional view taken along E-E line of FIG. 9A.

As shown in FIG. 8A, the hinge structure 1 mainly consists of a long hinge member 10 formed in a hook shape, a linear member 20 wired along the hinge member 10, and a cover member 30 which is fixed to the hinge member 10 and covers the linear member 20 together with the hinge member 10, as well as holds the linear member 20.

As shown in FIG. 8A, the hinge member 10 is made of a long metal member which supports the trunk lid 5 (see FIG. 1). The hinge member 10 has a role of an outer cover half body for covering the linear member 20 from a side of the corner portion 4*a* (see FIG. 1, FIG. 9A). The hinge member 10 includes a hinge body 12 to which the cover member 30 is fixed, an arm member 11 whose one end is fixed to the hinge body 12 and the other end is rotatably fixed to the vehicle body 2*a*, and a plurality (for example, three) of cover fixing brackets 14 for fixing the cover member 30 to the hinge body 12. In other words, in the hinge member 10, a rectangular tubular arm member 11 whose one end (anchor portion side) is rotatably fixed to the vehicle body 2*a* and the hinge body 12 curving and extending rearward from the other end (front end portion side) of the arm member 11 and having a cross section of approximately a reverse-J shape are jointed by, for example, welding. In addition, the plurality of the cover fixing brackets 14 are fixed on the hinge body 12 facing the cover member 30 by, for example, welding.

A cross section of the hinge member 10 in the extending direction is formed in a shape following the shape of the corner portion 4*a* of the opening portion 4 (see FIG. 9A).

As shown in FIG. 8A, in the hinge member 10, the arm member 11 is a portion which is rotatably fixed to the vehicle body 2*a*, and disposed to be housed inside the vehicle body 2*a*. On one end (anchor portion) of the arm member 11, a through hole 11*a* for inserting a rotation axis C which is disposed in the vehicle body 2*a* is formed.

In the hinge member 10, the hinge body 12 is a portion which includes a part to be fixed to the trunk lid 5 and arranged inside the trunk lid 5, and the part to be arranged exposed from the trunk lid 5 and the vehicle body 2*a* and form a tubular body which covers the linear member 20 together with the cover member 30. The hinge body 12 includes a curved portion 12*a* curving along a rotation trajectory circle with a predetermined radius and centering on the rotation axis C and a trunk lid fixing portion 12*b* extending along a backside of the trunk lid 5 from an end portion (front end portion) opposite to the arm member 11 (see FIG. 1). An edge portion of the opening portion 4 of the trunk room 3 is arranged in a space between the arm member 11 and the curved portion 12*a* of the hinge body 12 (see FIG. 1, FIG. 9A).

In the curved portion 12*a*, a cross sectional shape perpendicular to the longitudinal direction is formed with curvature, and a space capable of housing the cover fixing bracket 14 is formed inside a concave surface 12*c* facing the cover member 30. The cover fixing bracket 14 for fixing the cover member 30 to the curved portion 12*a* is disposed at three points, that is, the center in the longitudinal direction and both ends of the concave surface 12*c* inside the concave surface 12*c*. The trunk lid fixing portion 12*b* is fixed on the backside of the trunk lid 5 (see FIG. 1) by, for example, a weld bolt (not shown). A plurality of bolt inserting holes 12*d* for inserting the weld bolt are vertically bored in the trunk lid fixing portion 12*b*.

As shown in FIG. 8A, the cover fixing bracket 14 is a thin metal member having approximately a rectangular shape for holding the cover member 30 on the hinge member 10, and fixed inside the concave surface 12*c* of the hinge body 12 by, for example, spot welding. The cover fixing bracket 14 includes a protruding portion 14*a* formed in the center portion of the cover fixing bracket 14, a welding portion W which is arranged on a lower place in the vicinity of four corners on both sides of the protruding portion 14*a* and in close contact with the curved portion 12*a*, and a first cover fixing hole 14*b* and second cover fixing hole 14*c* which are bored in the protruding portion 14*a*.

As shown in FIG. 8A, FIG. 8D, and FIG. 9A, the welding portion W is a place where the cover fixing bracket 14 and the concave surface 12*c* of the hinge body are welded. The welding portion W is formed in a bended form so that one end and the other end on the front end side and anchor portion side of the cover fixing bracket 14 are closely contacted with the concave surface 12*c* as seen from the longitudinal direction of the hinge body 12.

The protruding portion 14*a* is formed between the welding portions W, W at both ends of the cover fixing bracket 14 so as to trapezoidally protrude toward the cover member 30 from the welding portions W, W. A space for disposing a clipping claw at each end of a first elastic clipping part 30*b* and second elastic clipping part 30*c* is formed between the protruding portion 14*a* and the concave surface 12*c* (see FIG. 9B).

As seen in FIG. 8A, the first cover fixing hole 14*b* and the second cover fixing hole 14*c* are holes into which the first elastic clipping part 30*b* and the second elastic clipping part 30*c* are inserted to be clipped. The first cover fixing hole 14*b* and the second cover fixing hole 14*c* are bored on a flat place of the protruding portion 14*a*.

As shown in FIG. 8A, the linear member 20 consists of, for example, a harness 21 to be connected to a number plate lighting lamp and the like (not shown) for lighting the number plate 2*b* disposed on the trunk lid 5 and the open cable 22 and the like to be connected to a locking device (not shown) of the trunk lid 5 (see FIG. 1). The liner member 20 is held by a linear member holding part 30*d* which is projectedly and integrally formed on the concave surface 30*a* of the cover member 30 made of resin.

As shown in FIG. 8C and FIG. 9A, the linear member 20 is disposed to be housed inside a concave surface 30*a* of the cover member 30 which is arranged facing the concave surface 12*c* of the hinge body 12 formed along the rotation trajectory of the hinge member 10. The linear member 20 is inserted between a pair of linear member holding parts 30*d*, 30*d*, and fixed inside a tubular body formed by the cover member 30 and hinge body 12.

As shown in FIG. 8D, when the linear member 20 exists between the cover member 30 and the hinge body 12, the harness 21 and open cable 22 are held by the center portion of the protruding portion 14*a* of the cover fixing bracket 14 so that the harness 21 and open cable 22 are not run off from between the linear member holding parts 30*d*, 30*d* (see FIG. 8C).

The harness 21 is an electric wire for supplying electricity to, for example, a lamp, and one end of the harness 21 is connected to the lamp and the other end is connected to a power source through the lighting switch (not shown).

The open cable 22 is, for example, a cable for transmitting the operation of unlocking lever (not shown) disposed in the driver's seat to a locking device of the trunk lid 5, and if the unlocking lever is pulled, the locking device of the trunk lid 5 is unlocked.

As shown in FIG. 8A, the cover member 30 is a plate member made of resin for covering the concave surface 12*c* in the curved portion 12*a* of the hinge member 10 and clipped to the hinge member 10 from the inner side of the opening portion 4, and accordingly, have a function as an inner cover half body which covers the linear member 20. The cover member 30 is arranged on the inner side of the opening portion 4 by fitting the cover member 30 with the curved portion 12*a* of the hinge member 10 which is disposed on the side of the corner portion 4*a* of the opening portion 4, and assembled to form the tubular body, where the linear member 20 is inserted, together with the hinge member 10.

As shown in FIG. 8A, the cover member 30 is a thin metal plate member extending along the curved portion 12*a* of the hinge member 10 and the trunk lid fixing portion 12*b*. The cover member 30 is formed in approximately a J-shape in the cross sectional view (see FIG. 8B to FIG. 8D). On the concave surface 30*a* of the cover member 30, the first elastic clipping part 30*b* and the second elastic clipping part 30*c*, the linear member holding part 30*d*, a first support part 30*e* (see FIG. 8B), and a second support part 30*f* are integrally and projectedly formed toward the concave surface 12*c* of the hinge body 12.

As shown in FIG. 8A, FIG. 8D, FIG. 9A, and FIG. 9B, the first elastic clipping part 30*b* and the second elastic clipping part 30*c* are projections having a clipping claw on outer side of the front end portion. The first elastic clipping part 30*b* and the second elastic clipping part 30*c* are clipped to edges of the first cover fixing hole 14*b* and the second cover fixing hole 14*c* of the cover fixing bracket 14 by, so-called snap-fit. It is noted that the cover member 30 is clipped by inserting the first elastic clipping part 30*b* and the second elastic clipping part 30*c* into the first cover fixing hole 14*b* and the second cover fixing hole 14*c*, respectively, and accordingly, the cover member 30 is fixed to the hinge member 10.

As shown in FIG. 8A and FIG. 9B, the first elastic clipping part 30*b* is disposed at three points on an upper end portion of the concave surface 30*a*. The first elastic clipping part 30*b* is clipped by inserting a clipping claw, which is formed on the inner side of the front end, into the first cover fixing hole 14*b* of the cover fixing bracket 14 from the backside. The second elastic clipping part 30*c* consists of a pair of projections which are vertically disposed at a distance from each other, and when the second elastic clipping part 30*c* is inserted into the second cover fixing hole 14*c*, a clipping claw having a tapered surface is pressed on the edge of the second cover fixing hole 14*c* to elastically deform the second elastic clipping part 30*c*. If the clipping claw passes through the second cover fixing hole 14*c*, the second elastic clipping part 30*c* restores the original form.

Through the processes described above, the first elastic clipping part 30*b* and the second elastic clipping part 30*c* are clipped to the edges of the first cover fixing hole 14*b* and the second cover fixing hole 14*c*, respectively, and consequently, the cover member 30 can be easily fixed to the hinge member 10 with one touch. Therefore, the hinge member 10 and the linear member 20 are shadowed by the cover member 30, thereby resulting in improvement of the appearance of the hinge structure 1. In addition, for example, a fastener member such as a screw and a through hole for inserting the fastener member are unnecessary when the cover member 30 is fixed to the hinge member 10. Therefore, an external surface on internal side of the opening portion 4 of the trunk room 3 can be formed with a good appearance. As a result, an aesthetic quality of the hinge structure 1 can be improved.

As shown in FIG. 8A, FIG. 8C, and FIG. 9A, the linear member holding parts 30*d*, 30*d* are vertically disposed at a distance from each other. The linear member holding parts 30*d*, 30*d* are a pair of projections where clipping claws for holding the linear member 20 are disposed facing each other at each front end portion of the projections, and formed at a plurality of places on the concave surface 30*a*. The linear member holding part 30*d* is integrally formed with a stiffening rib on the backside portion of the linear member holding part 30*d* for stiffening the linear member holding part 30*d*, and with a rib for supporting the linear member 20 inside the linear member holding part 30*d*. If the linear member 20 is fixed in a space between the liner member holding parts 30*d*, 30*d*, the clipping claws clip the harness 21 so that the linear member 20 is not run off from the space.

As shown FIG. 8A, FIG. 8B, and FIG. 9A, the first support part 30*e* is a projection for preventing the hinge body 12 and the cover member 30 from wobbling due to contact with an upper end portion of the concave surface 12*c* of the hinge body 12 and out of alignment between the hinge body 12 and the cover member 30 when the hinge body 12 and the cover member 30 are clipped. The first support part 30*e* is disposed at a position to the center line by a thickness of the hinge body 12 from the upper end of the concave surface 30*a* of the cover member 30 (see FIG. 8B). If the hinge body 12 and the cover member 30 are fitted, since an outer side of front end portion of the first support part 30*e* comes in contact with the concave surface 12*c* of the hinge body 12, the cover member 30 is clipped to the hinge member 10 without wobbling.

As shown in FIG. 8A, FIG. 8B, and FIG. 9A, the second support part 30*f* is a projection for preventing the hinge body 12 and the cover member 30 from wobbling due to contact with a lower end portion of the concave surface 12*c* of the hinge body 12 and out of alignment between the hinge body 12 and the cover member 30 when the hinge body 12 and the cover member 30 are clipped. The second support part 30*f* is projectedly disposed toward the hinge body 12 from a position shifted to the center line by the thickness of the hinge body 12 from the inner surface of the lower end portion of the concave surface 30*a* of the cover member 30 (see FIG. 8B). If the hinge body 12 and the cover member 30 are fitted each other, a lower edge portion of the hinge body 12 is inserted in a space between the outer side of front end portion of the second support part 30*f* and a lower edge of the cover member 30, and the cover member 30 is clipped to the hinge member 10 without wobbling, accordingly.

Next, operations and effects of the hinge structure 1 according to the second embodiment will be explained by mainly referring to FIG. 8A to 8D and FIG. 9A to 9B.

As shown in FIG. 9A, a portion facing the corner portion 4*a* of the opening portion 4 on the outer periphery surface of the hinge member 10, that is, an outer periphery surface of the curved portion 12*a* of the hinge body 12 is formed in a shape following the corner portion 4*a* of the opening portion 4. In other words, the outer periphery surface of the hinge member 10 is formed approximately in parallel with the corner portion 4*a* of the opening portion 4. Therefore, distances L1, L2 between the outer periphery surface of the hinge member 10 and the corner portion 4*a* become approximately constant. As a result, the hinge member 10 can be arranged closer to the corner portion 4*a*, and an extent of protrusion of the hinge structure 1 inward the opening portion 4 of the trunk room 3 can be reduced.

Therefore, since a distance between the right and left hinge structures 1 arranged at the right and left corner portions 4*a* of the trunk room 3 is enlarged, thereby a supporting span of the trunk lid 5 can be enlarged, a holding power and supporting stiffness of the trunk lid 5 by the hinge structure 1 can be improved.

In addition, the cover member 30 is fixed to the hinge member 10 under the condition that the linear member 20 is held inside the concave surface 30*a* by the linear member holding part 30*d*.

Figure 17:
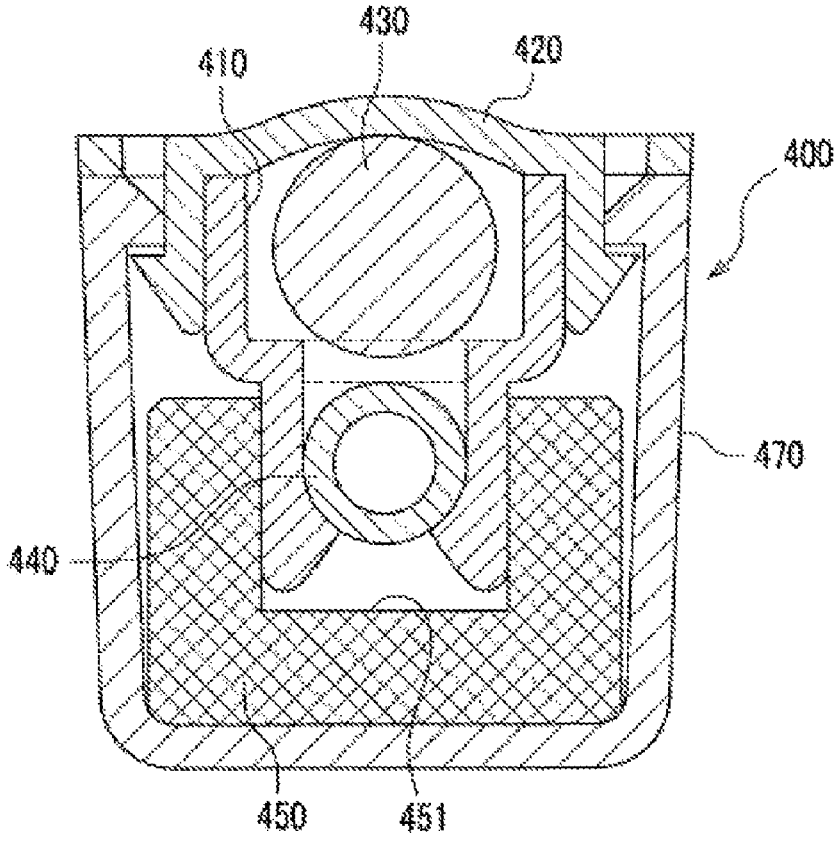
FIG. 17 Prior Art
FIG. 17 is an illustration showing a hinge structure of a conventional vehicle open/close body, which is a main part enlarged cross sectional view of a hinge member provided with a harness.

That is, in the conventional hinge structure 400 shown in FIG. 17, when the cover member 470 is fixed to the hinge member 450, it is required that the cover member 470 and the cap member 420 are clipped after the harnesses 430, 440 are mounted on the protector body 410. However, in the hinge structure 1 according to the second embodiment, since the cover member 30 which clips the linear member 20 is independently held on the hinge member 10, workability of assembling the cover member 30 can be improved.

In addition, as shown in FIG. 9A, the hinge member 10 is arranged at a position near the corner portion 4*a*, that is, the position close to the corner portion 4*a* within the hollow tubular member formed by combining the hinge body 12 as the outer cover and the cover member 30 as the inner cover, compared with the linear member 20 and cover member 30.

Therefore, a level of freedom for designing the cover member 30, which constitutes a portion of the hinge structure 1 distant from the corner portion 4*a*, is improved. As a result, the cover member 30 can be formed in a flat shape in cross sectional view so that the cover member 30 protrudes inward toward the opening portion 4 a lessened amount that is as small as possible, and in a shape so that a whole cross sectional shape of the hinge structure 1 follows an outer shape of the corner portion 4*a* having a circular arc shape. Accordingly, an appearance of the hinge structure 1 can be improved, and the distances L1, L2 between the hinge structure 1 and the corner portion 4*a* can be narrowed.

In the hinge structure 1 formed as described above, the cover member 30 is disposed on the inner side of the opening portion 4 of the trunk room 3, and, for example, when the driver loads and unloads baggage on and from the trunk room 3, the hinge member 30 is shadowed by the cover member 30 and the linear member 20 is housed inside the tubular body formed by the hinge member 10 and the cover member 30 so that the linear member 20 can not be seen from the outside. Accordingly, an improvement of the appearance, small-footprint, and downsizing of the hinge structure 1 as well as widening of the trunk room 3 can be achieved.

Since the hinge structure 1 consists of the hinge body 12 and cover fixing bracket 14 which are formed by press work of a metal plate and a resin member having approximately a flat shape to be fixed to the hinge body 12, the hinge structure 1 can be reduced in size and weight as a whole.

As shown in FIG. 9A, the harness 21 is disposed on a surface Y containing a rotation trajectory of the hinge member 10 and adjacent to the hinge member 10. Therefore, a width dimension of the cover member 30 in a direction perpendicular to the surface Y can be made small. As a result, a protrusion of the cover member 30 inward the opening portion 4 can be minimized, thereby interferences to baggage by the hinge member 10 can be suppressed to the minimum.

Third Embodiment

Next, a third embodiment of the present invention will be explained in detail by referring to FIG. 10 and FIGS. 11A and 11B.

Figure 10:
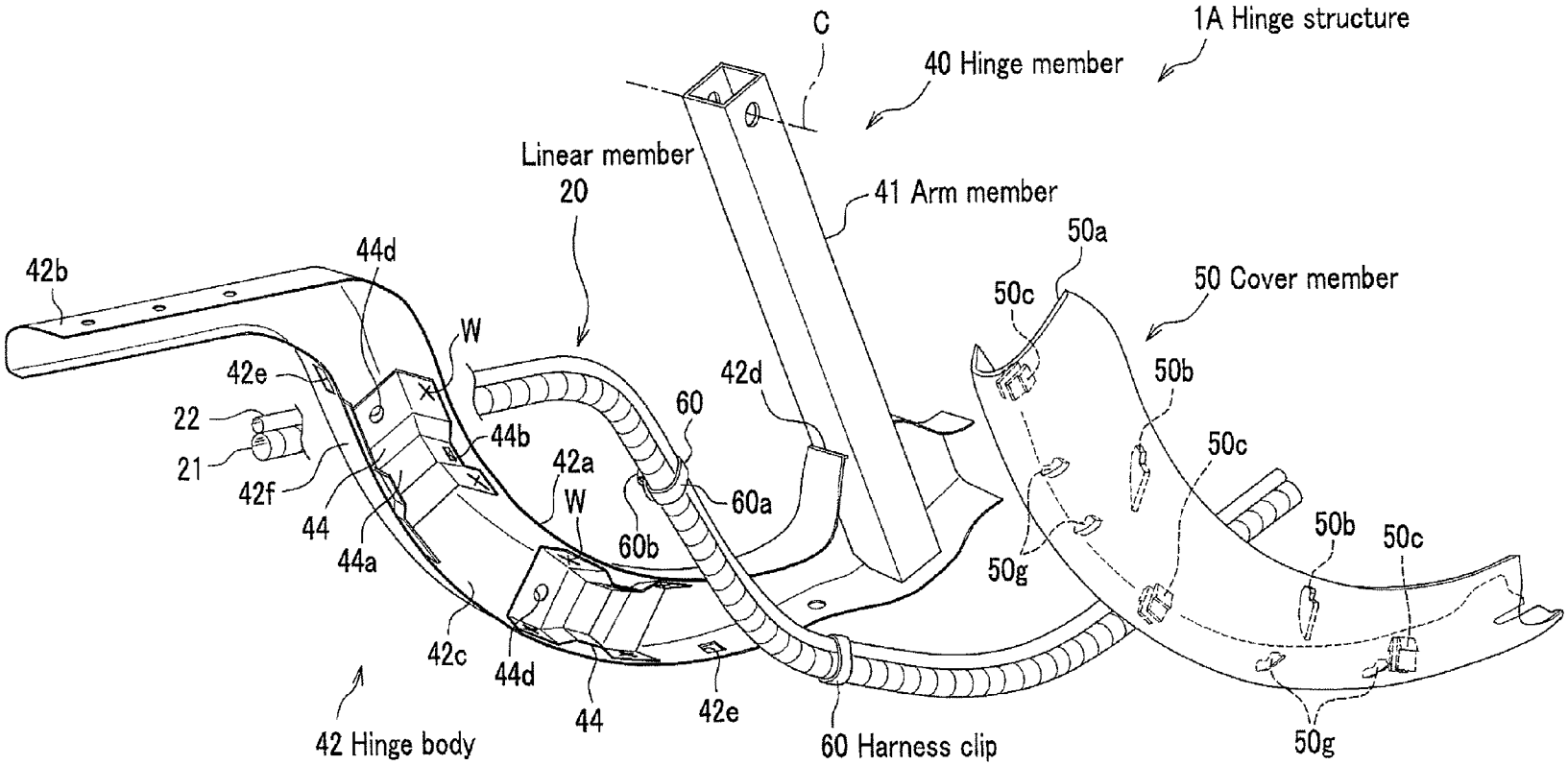
FIG. 10 is an exploded perspective view showing a hinge structure according to a third embodiment of the present invention.
Figure 11A:
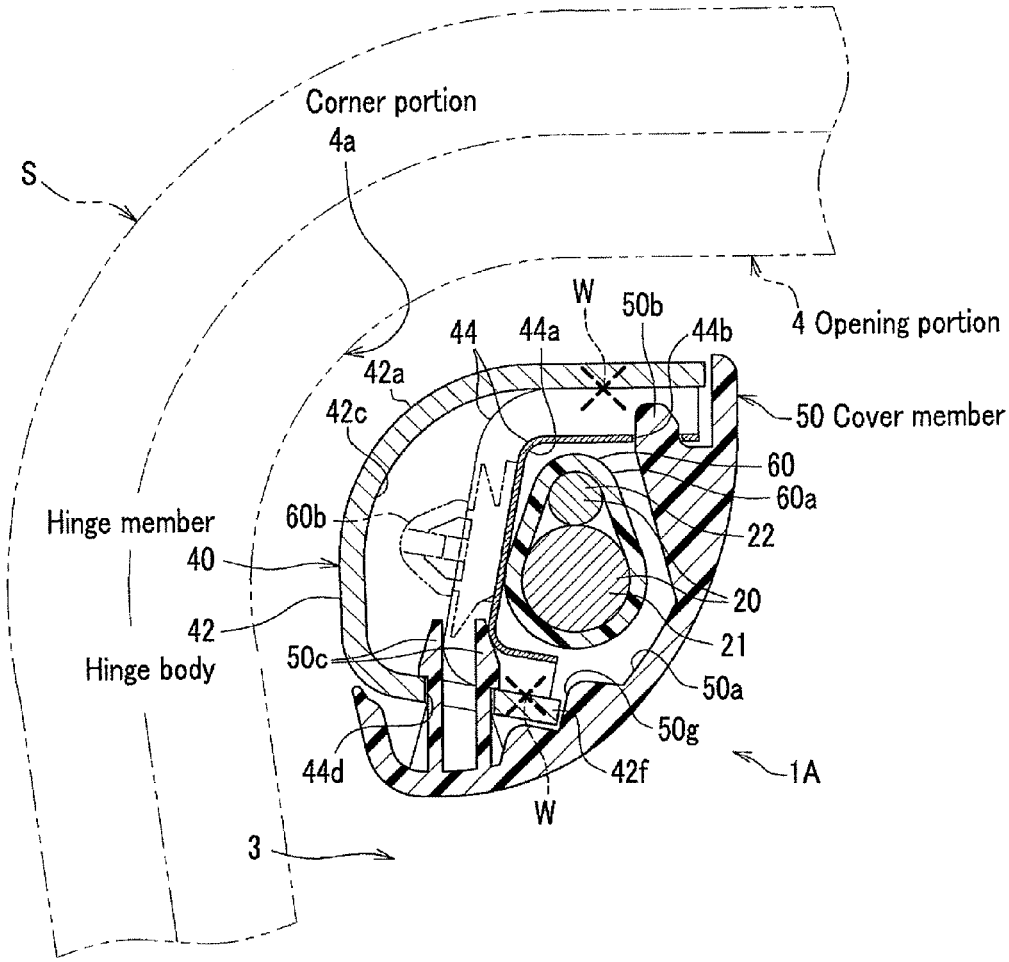
FIG. 11A is an illustration showing a hinge structure according to the third embodiment, which is an enlarged cross sectional view showing an installation condition of the hinge member in an opening portion of a trunk lid.
Figure 11B:
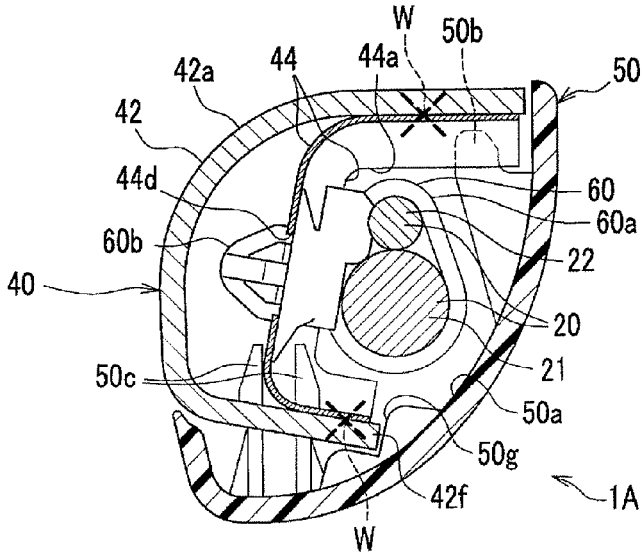
FIG. 11B is an illustration showing a hinge structure according to the third embodiment, which is an enlarged cross sectional view showing a clip fixing condition.

FIG. 10 is an exploded perspective view showing a hinge structure according to the third embodiment of the present invention. FIG. 11A is an illustration showing a hinge structure according to the third embodiment, which is an enlarged cross sectional view showing an installation condition of the hinge structure in an opening portion of a trunk lid. FIG. 11B is an illustration showing a hinge structure according to the third embodiment, which is an enlarged cross sectional view showing a clip installation condition.

As shown in FIG. 10, a hinge structure 1A according to the third embodiment is provided with a hinge member 40, a linear member 20 is disposed along the hinge member 40, and the linear member 20 is held on the hinge member 40 made of metal by a harness clip 60. The hinge structure 1A mainly consists of the hinge member 40, the linear member 20 wired inside the hinge member 40, the harness clip 60 binding up the linear member 20 and fixed to the hinge member 40, and a cover member 50 made of resin for forming a tubular body, which covers the linear member 20, together with the hinge member 40.

The hinge member 40 is built by welding an arm member 41, a hinge body 42, and a cover fixing bracket 44, as with the hinge member 10 (see FIG. 8A) according to the second embodiment.

The arm member 41 is made of a tubular member having a shape approximately identical to that of the arm member 11 (see FIG. 8A) of the second embodiment, and inserted and welded to a recess portion 42*d* of the hinge body 42.

The hinge body 42 is formed by press work of a metal plate member, as with the hinge body 12 (see FIG. 8A) of the second embodiment. The hinge body 42 includes a curved portion 42*a* which is formed in a curvature along a rotation trajectory circle, a concave surface 42*c* formed in a curvature of approximately a U-shape along the corner portion 4*a* (see FIG. 11A, FIG. 11B) as a whole as seen from the longitudinal direction, a trunk lid fixing portion 42*b* described later, the recess portion 42*d*, and a second cover fixing hole 42*e*. A cover fixing bracket 44 which is formed in a curvature and to be welded to a concave surface 42*c* is fixed to the hinge body 42, as with the cover fixing bracket 14 (see FIG. 8A) of the second embodiment. Other than the above, a harness clip 60 to be fixed to the cover fixing bracket 44, the linear member 20 to be held inside the concave surface 42*c* by the harness clip 60, and a cover member 50 to be fixed to the hinge body 42 so as to open and close the concave surface 42*c* are fixed to the hinge member 40.

The concave surface 42*c* which opens to the side of the cover member 50 is continuously formed in the curved portion 42*a* and trunk lid fixing portion 42*b* to form a space so that the linear member 20 can be housed. A plurality of second cover fixing holes 42*e*, into which a pair of second elastic clipping parts 50*c* are snap-fitted, are bored at a plurality of places on a bottom surface of the curved portion 42*a*.

The cover fixing bracket 44 is formed by bending a rectangular metal plate member and welded to tow points on the concave surface 42*c* of the hinge body 42. The cover fixing bracket 44 includes a welding portion W which is formed at four corners of the cover fixing bracket 44 and closely welded to the concave surface 43*c*, a protruding portion 44*a* for supporting the linear member 20, a first cover fixing hole 44*b* bored in top and bottom end portions of the protruding portion 14*a*, and a clip fixing hole 44*d* bored in the center between the welding portion W, W on the front end side.

The first cover fixing hole 44*b* is a hole for inserting the first elastic clipping part 50*b* therein from the bottom side.

The harness clip 60 is made of resin consisting of a band portion 60*a* and clip portion 60*b* which are integrally formed, and fixes the linear member 20 by winding it with the band portion 60*a* at two points. The two clip portions 60*b* are fixed inside the hinge body 42 through two cover fixing brackets 44, respectively.

The harness 21 and open cable 22 of the linear member 20 are bound by the band portion 60*a* of the harness clip 60. The clip portion 60*b* of the harness clip 60 is clipped to the clip fixing hole 44*d* of the cover fixing bracket 44. Therefore, the harness 21 and open cable 22 are held inside the concave surface 42*c* of the hinge body 42.

The cover member 50 is a plate member made of resin having approximately a J-shape in the cross sectional view and disposed on the inner side of the hinge member 40 in the opening portion 4 so as to cover the concave surface 42*c* of the curved portion 42*a*, as with the cover member 30 (see FIG. 8A) of the second embodiment. On a concave surface 50*a* of the cover member 50, a plurality of first elastic clipping parts 50*b*, a pair of second elastic clipping parts 50*c*, and a plurality of clipping parts 50*g* are integrally and projectedly formed toward the hinge body 42.

The first elastic clipping part 50*b* is projectedly disposed upward from the concave surface 50*a* of the cover member 50, and a front end portion thereof is inserted into the first cover fixing hole 44*b*. The second elastic clipping part 50*c* is disposed at a plurality of places on the concave surface 50*a* of the cover member 50 and has a clipping claw at the end portion.

The clipping part 50*g* is a portion to which the end of lower end portion 42*f* of the hinge body 42 is clipped, and consists of a protrusion formed in approximately a V-shape.

Therefore, in the cover member 50, the first elastic clipping part 50*b* is clipped to the first cover fixing hole 44*b* of the cover fixing bracket 44, the clipping part 50*g* is clipped to the lower end portion 42*f* of the hinge body 42, and the second elastic clipping part 50*c* is clipped to the second cover fixing hole 42*e* of the hinge body 42. As a result, the cover member 50 is fixed to the hinge member 40 from the bottom side. In addition, in the third embodiment, since the cover member 50 is fixed to the hinge member 40 after the linear member 20 is fixed to the hinge member 40, the assembly work of the cover member 50 becomes easy. The third embodiment also has effects and advantages similar to those of the second embodiment.

Fourth Embodiment

Figure 12:
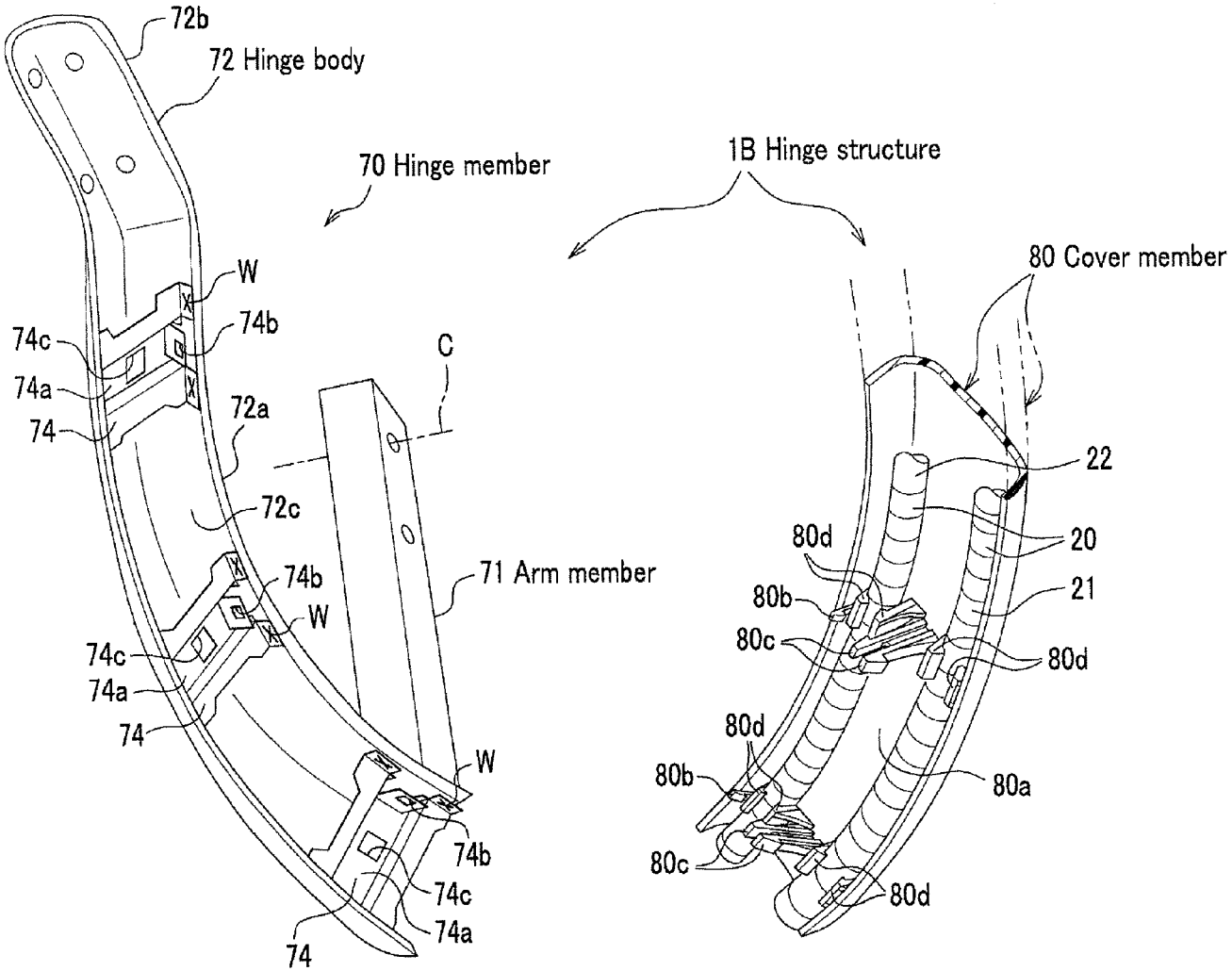
FIG. 12 is an exploded perspective view showing a hinge structure according to a fourth embodiment of the present invention.
Figure 13:
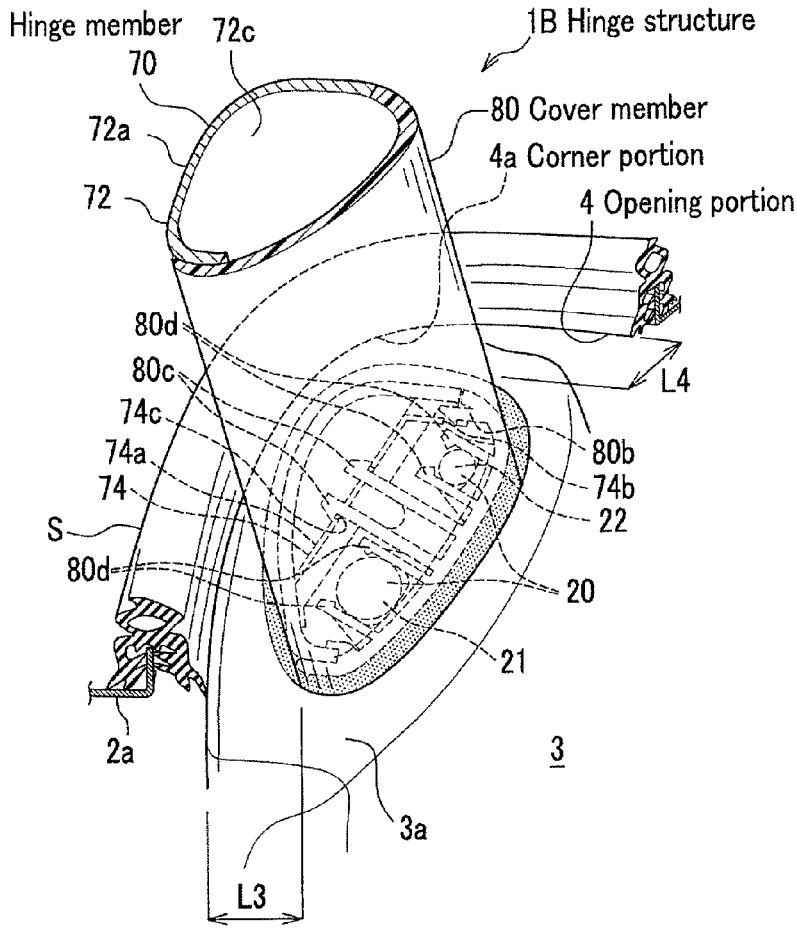
FIG. 13 is a perspective view showing a hinge structure according to the fourth embodiment.
Figure 14:
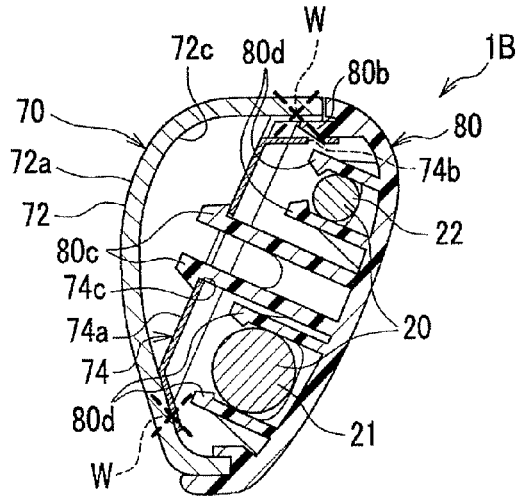
FIG. 14 is a cross sectional view showing a hinge structure according to the fourth embodiment.
Figure 15:
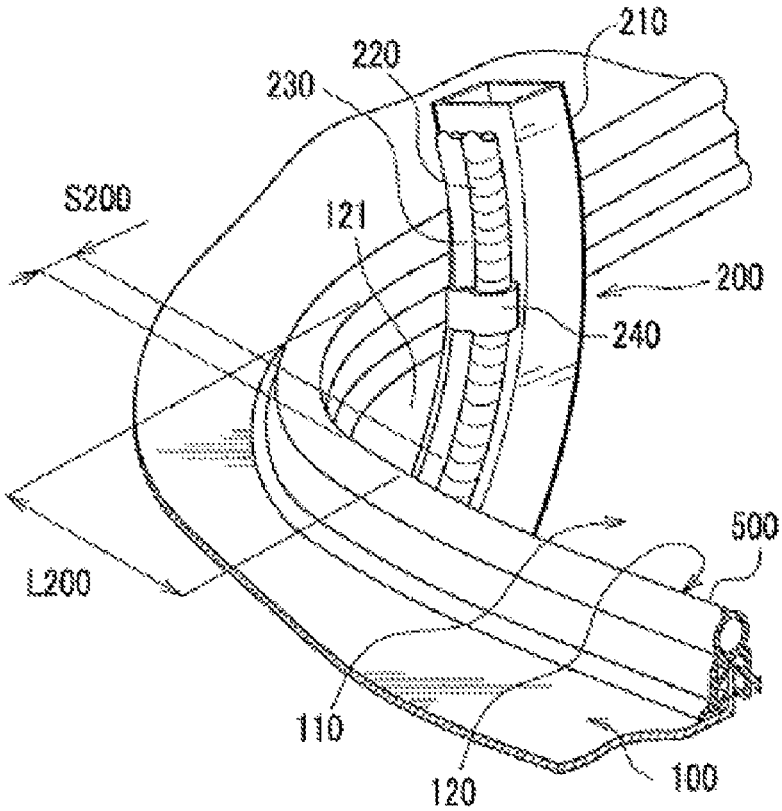
FIG. 15 Prior Art
FIG. 15 is an illustration showing an installation condition of a hinge structure of a conventional vehicle open/close body, which is an enlarged perspective view of a corner portion of a trunk room when the open/close body is opened.
Figure 16:
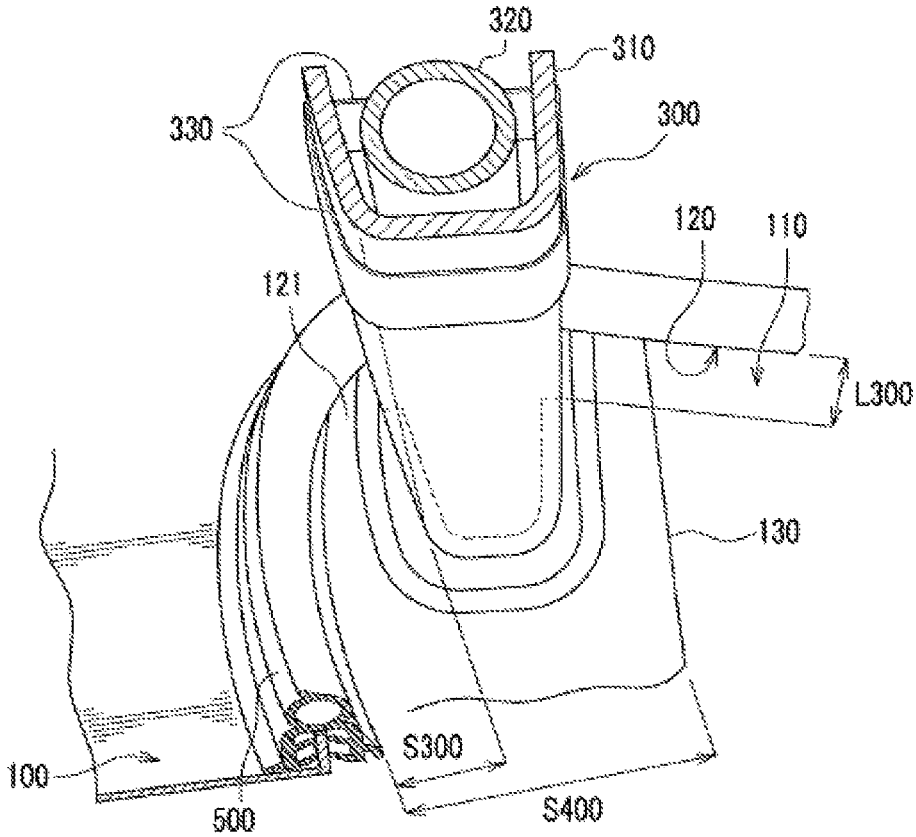
FIG. 16 Prior Art
FIG. 16 is an illustration showing an installation condition of a hinge structure of a conventional vehicle open/close body, which is an enlarged perspective view of a corner portion of a trunk room when the open/close body is opened.

Next, a fourth embodiment according to the present invention will be explained in detail by referring to FIG. 12 to FIG. 14. FIG. 12 is an exploded perspective view showing a hinge structure according to a fourth embodiment of the present invention. FIG. 13 is a perspective view showing a hinge structure according to the fourth embodiment. FIG. 14 is a cross sectional view showing a hinge structure according to the fourth embodiment.

As shown in FIG. 12, in the hinge structure 1B according to the fourth embodiment, the harness 21 and open cable 22 of the linear member 20 are separately disposed at a distance from each other along a hinge member 70, and the linear member 20 is held by a cover member 80 made of resin. The hinge structure 1B mainly consists of the hinge member 70, the linear member 20 wired along the hinge member 70, and a cover member 80 made of resin which fits in the hinge member 70 and covers a plurality of linear members 20, while separately holding each of the linear members 20.

The hinge member 70 is formed by welding an arm member 71 which is rotatably supported by the rotation axis C, a hinge body 72 which is continuously disposed from the arm member 71 and includes a curved portion 72*a* and trunk lid fixing portion 72*b*, and a plurality of cover fixing brackets 74 disposed on a concave surface 72*c* of the hinge body 72, as with the hinge member 10 (see FIG. 8A) of the second embodiment.

The arm member 71 and hinge body 72 of the hinge member 70 are formed in shapes approximately identical to those of the arm member 11 and hinge member 12 of the second embodiment (see FIG. 8A), and welded and continuously disposed to each other. The arm member 71 is made of metal member having a rectangular tubular shape.

The hinge body 72 is made of a metal plate member which is formed in a reverser shape in the cross section by press work, and in the hinge body 72, the curved portion 72*a* formed along a rotation trajectory circle, the concave surface 72*c* formed in a curvature of approximately a U-shape as a whole along the corner portion 4*a*, and the trunk lid fixing portion 72*b* are integrally formed. The hinge body 72 is provided with a cover fixing bracket 74 to be welded to the concave surface 72*c*, as with the cover fixing bracket 14 (see FIG. 8A) of the second embodiment. In addition, the cover member 80 and linear member 20 are fixed to the hinge body 72.

The cover fixing bracket 74 is formed by bending a rectangular metal plate member and disposed at three points on the concave surface 72*c* of the hinge body 72. A welding portion W, a depressed surface 74*a*, a first cover fixing hole 74*b*, and a second cover fixing hole 74*c* are formed in a cover fixing bracket 74. The welding portion W is a place where the cover fixing bracket 74 is spot-welded to the hinge member 70, and arranged close to the concave surface 72*c* disposed at four corners of the cover fixing bracket 74. The depressed surface 74*a* is a portion which is depressed from the surrounding area, and reinforces the cover fixing bracket 74 by bending the surrounding area. The first cover fixing hole 74*b* is a hole for clipping a clipping claw of the first elastic clipping part 80, and bored in a projected part adjacent to the depressed surface 74*a* (see FIG. 14). The second cover fixing hole 74*c* is a hole bored in the center portion of the depressed surface 74*a* to which the second elastic clipping part 80*c* is clipped.

The harness 21 and open cable 22 of the linear member 20 are held in the concave surface 80*a* of the cover member 80 by separately clipped between linear member holding parts 80*d*, 80*d*, which are arranged in a pair facing to each other, under the condition that the harness 21 and open cable 22 are wound by, for example, a protection tape.

As with the cover member 30 (see FIG. 8A) according to the second embodiment, the cover member 80 is a plate member made of resin having approximately a J-shape in cross sectional view, and disposed on the inner side of the hinge member 70 in the opening portion 4 so that the cover member 80 shields and covers the concave surface 72*c* of the curved portion 72*a*. The cover member 80 is fixed to the hinge member 70 by clipping the first elastic clipping part 80*b* and the second elastic clipping part 80*c* to the first cover fixing hole 74*b* and the second cover fixing hole 74*c* of the cover fixing bracket 74, respectively, with snap-fit.

On the concave surface 80*a* of the cover member 80, a plurality of the first elastic clipping parts 80*b* and the second elastic clipping parts 80*c* for fixing the cover member 80 to the hinge member 70 and a pair of linear member holding parts 80*d* which are disposed on both sides of the second elastic clipping parts 80*c*, which are projectedly disposed in the center portion of the concave surface 80*a* as seen from the longitudinal direction, are integrally and projectedly disposed toward the hinge body 72.

The first elastic clipping part 80*b* is projectedly disposed toward the hinge body 72 from the concave surface 80*a* of the cover member 80, and has a clipping claw at the front end portion. The clipping claw of the first elastic clipping part 80*b* is clipped to the first cover fixing hole 74*b* from the outside of the cover fixing bracket 74, and thereby holds the upper side of the cover member 80.

Therefore, in the cover member 80, the first elastic clipping part 80*b* and the second elastic clipping part 80*c* are clipped to the first cover fixing hole 74*b* and the second cover fixing hole 74*c* of the cover fixing bracket 74, respectively. As a result, the cover member 80 can be fixed to the hinge member 70 with one-touch operation.

As shown in FIG. 13, in the hinge member 70 and the cover member 80 which are assembled into a tubular shape as described above, the hinge member 70 can be formed in a flat shape in cross sectional view so that the cover member 80 protrudes inward toward the opening portion 4 in a lessened amount that is as small as possible, as well as can be disposed close to the corner portion 4*a*. Therefore, distances L3, L4 between the hinge structure 1 and the corner portion 4*a* can be narrowed by forming a cross sectional shape of the whole hinge structure 1 in a shape following the shape of the corner portion 4*a*. Accordingly, a protruding amount of the lining 3*a*, into which an anchor portion side of the hinge member 70 is inserted, inward the opening portion 4 can be suppressed, thereby resulting in enlargement of the capacity of the trunk room 3.

The preferred embodiments of the present invention have been explained in detail by referring to drawings. However, the present invention is not limited to the first to fourth embodiments and can be embodied in various forms without departing from the spirits of the present invention.

For example, in the first embodiment, the open cable 22 is arranged in the holding groove 35 of the lateral rib 31*e* which is formed on the inner periphery surface 31*c* of the outer cover 31. However, in the same fashion with the harness 21, the open cable 22 may be arranged on the lateral surface 12*d* of the hinge member 10, which is on the opposite side of the rotation axis C, and adjacent to the harness 21. With the arrangement described above, a dimension of the hinge structure 1 in the right-left direction may be made smaller.

In addition, in the second to fourth embodiments, the harness 21 for the lamp for lighting the number plate and the open cable 22 in the hinge structures 1, 1A, and 1B were exemplified to explain the linear member 20. However, other than these, harnesses connected to, for example, a lamp other than that of the number plate and electric devices disposed in the trunk lid 5, and a rear window washer hose may be included in the linear member 20.

Further, the trunk lid 5 was exemplified as an example of the open/close body. However, the open/close body is only required to use a hinge structure, and, for example, a sidedoor, a backdoor, and a bonnet may be the open/close body.

What is claimed is:

1. A hinge structure for a vehicle open/close body, in which a long hinge member supporting the open/close body is rotatably disposed adjacent a corner portion of an opening portion of a vehicle body and the hinge member rotates according to an opening and closing motion of the open/close body, comprising:

a cover member for covering the hinge member is disposed on the hinge member, the cover member including an outer periphery surface facing the corner portion of the opening portion, wherein the outer periphery surface is formed in a shape that is similar to a shape of the corner portion such that the outer periphery surface is radially parallel to the corner portion.

2. The hinge structure for a vehicle open/close body according to claim 1, wherein the cover member includes an outer cover to be disposed on a side of the corner portion and an inner cover to be clipped to the outer cover from an inner side of the opening portion.

3. The hinge structure for a vehicle open/close body according to claim 2, wherein the outer cover and the inner cover are respectively fixed to the hinge member.

4. The hinge structure for a vehicle open/close body according to claim 3, wherein the hinge member is disposed near the corner portion within a cross section of the cover member.

5. The hinge structure for a vehicle open/close body according to claim 3, the hinge structure including a linear member to be disposed along the hinge member, wherein rotation of the hinge member about a rotation axis defines a rotation trajectory and the linear member is disposed on a surface containing the rotation trajectory of the hinge member and adjacent to the hinge member.

6. The hinge structure for a vehicle open/close body according to claim 2, wherein the hinge member is disposed adjacent to the outer cover within a cross section of the cover member.

7. The hinge structure for a vehicle open/close body according to claim 6, the hinge structure including a linear member to be disposed along the hinge member, wherein rotation of the hinge member about a rotation axis defines a rotation trajectory and the linear member is disposed on a surface containing the rotation trajectory of the hinge member and adjacent to the hinge member.

8. The hinge structure for a vehicle open/close body according to claim 2, wherein the hinge member is disposed near the corner portion within a cross section of the cover member.

9. The hinge structure for a vehicle open/close body according to claim 2, the hinge structure including a linear member to be disposed along the hinge member, wherein rotation of the hinge member about a rotation axis defines a rotation trajectory and the linear member is disposed on a surface containing the rotation trajectory of the hinge member and adjacent to the hinge member.

10. The hinge structure for a vehicle open/close body according to claim 1, wherein the hinge member is disposed near the corner portion within a cross section of the cover member.

11. The hinge structure for a vehicle open/close body according to claim 10, the hinge structure including a linear member to be disposed along the hinge member, wherein rotation of the hinge member about a rotation axis defines a rotation trajectory and the linear member is disposed on a surface containing the rotation trajectory of the hinge member and adjacent to the hinge member.

12. The hinge structure for a vehicle open/close body according to claim 1, the hinge structure including a linear member to be disposed along the hinge member, wherein rotation of the hinge member about a rotation axis defines a rotation trajectory and the linear member is disposed on a surface containing the rotation trajectory of the hinge member and adjacent to the hinge member.

13. A hinge structure for a vehicle open/close body, in which a long hinge member supporting the open/close body is rotatably disposed adjacent a corner portion of an opening portion of a vehicle body and the hinge member rotates according to an opening and closing motion of the open/close body, wherein a portion of the hinge member that faces the corner portion of the opening portion is formed in a shape that is similar to a shape of the corner portion such that the portion of the hinge member is radially parallel to the corner portion; and wherein the hinge member is disposed near the corner portion and a cover member is clipped to the hinge member from an inner side of the opening portion.

14. The hinge structure for a vehicle open/close body according to claim 13, wherein the hinge member includes a hinge body to which the cover member is fixed and an arm member whose one end is fixed to the hinge body and the other end is rotatably fixed to the vehicle body.

15. The hinge structure for a vehicle open/close body according to claim 14, wherein a linear member is disposed along the hinge member and the linear member is held by the cover member made of resin.

16. The hinge structure for a vehicle open/close body according to claim 14, wherein a linear member is disposed along the hinge member and the linear member is held by the cover member made of metal.

17. The hinge structure for a vehicle open/close body according to claim 13, wherein a linear member is disposed along the hinge member and the linear member is held by the cover member made of resin.

18. The hinge structure for a vehicle open/close body according to claim 13, wherein a linear member is disposed along the hinge member and the linear member is held by the cover member made of metal.

* * * * *